US009772570B2

(12) United States Patent
Tsuda et al.

(10) Patent No.: US 9,772,570 B2
(45) Date of Patent: Sep. 26, 2017

(54) MAGNETIC TONER

(71) Applicant: CANON KABUSHIKI KAISHA, Tokyo (JP)

(72) Inventors: Shohei Tsuda, Suntou-gun (JP); Yojiro Hotta, Mishima (JP); Koji Nishikawa, Susono (JP); Masami Fujimoto, Suntou-gun (JP); Katsuhisa Yamazaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/812,793

(22) Filed: Jul. 29, 2015

(65) Prior Publication Data

US 2016/0041484 A1 Feb. 11, 2016

(30) Foreign Application Priority Data

Aug. 7, 2014 (JP) ..... 2014-161481

(51) Int. Cl.
*G03G 9/083* (2006.01)
*G03G 9/087* (2006.01)
*G03G 9/097* (2006.01)

(52) U.S. Cl.
CPC ..... *G03G 9/0839* (2013.01); *G03G 9/08782* (2013.01); *G03G 9/09716* (2013.01)

(58) Field of Classification Search
CPC ..... G03G 9/0839; G03G 9/00; G03G 9/08782
See application file for complete search history.

(56) References Cited

U.S. PATENT DOCUMENTS

| | | | | |
|---|---|---|---|---|
| 5,354,637 | A | 10/1994 | Shimamura et al. | |
| 5,716,746 | A | 2/1998 | Mikuriya et al. | |
| 6,653,036 | B1 | 11/2003 | Tanikawa et al. | |
| 7,323,279 | B2 | 1/2008 | Kato et al. | |
| 7,422,832 | B2 | 9/2008 | Ogawa et al. | |
| 7,544,455 | B2 | 6/2009 | Yoshiba et al. | |
| 8,501,377 | B2 | 8/2013 | Takahashi et al. | |
| 8,512,925 | B2 | 8/2013 | Moribe et al. | |
| 9,029,055 | B2 | 5/2015 | Aoki et al. | |
| 9,046,800 | B2 | 6/2015 | Hotta et al. | |
| 2007/0202424 | A1 | 8/2007 | Ogawa et al. | |
| 2011/0076610 | A1* | 3/2011 | Ogawa | G03G 9/0804 430/112 |
| 2014/0295341 | A1* | 10/2014 | Fomitchev | G03G 9/09716 430/108.22 |
| 2014/0315126 | A1* | 10/2014 | Magome | G03G 9/0825 430/108.3 |
| 2015/0125790 | A1 | 5/2015 | Hotta et al. | |

FOREIGN PATENT DOCUMENTS

| | | | |
|---|---|---|---|
| JP | 2002-318467 | A | 10/2002 |
| JP | 2004-138920 | A | 5/2004 |
| JP | 2005-202131 | A | 7/2005 |
| JP | 2007-293043 | A | 11/2007 |
| JP | 2010-032580 | | 2/2010 |
| JP | 2013-92748 | A | 5/2013 |
| RU | 2506620 | | 2/2014 |
| WO | 2013/063291 | A1 | 5/2013 |
| WO | 2013/100187 | A1 * | 7/2013 |

OTHER PUBLICATIONS

U.S. Appl. No. 14/807,656, filed Jul. 23, 2015. Inventors: Koji Nishikawa, et al.

* cited by examiner

*Primary Examiner* — Thorl Chea
(74) *Attorney, Agent, or Firm* — Fitzpatrick Cella Harper and Scinto

(57) ABSTRACT

Provided is a toner having good endurance stability and good low-temperature fixability in high-speed printing, and having good resistance to the adhesion of printed paper. The toner is a magnetic toner having, on the surface of toner particle containing a binder resin and an ester compound as a releasing agent, inorganic fine particle "a" and organic-inorganic composite fine particle having a volumetric specific heat of from 2,900 kJ/($m^3$·° C.) to 4,200 kJ/($m^3$·° C.), in which a coverage A of the surface of the toner particle with the inorganic fine particle "a" is 45.0% or more and 70.0% or less.

9 Claims, 2 Drawing Sheets

MAGNETIC TONER

BACKGROUND OF THE INVENTION

Field of the Invention

The present invention relates to a magnetic toner to be used in electrophotography, an image forming method for visualizing an electrostatic image, and a toner jet (hereinafter sometimes referred to simply as "toner").

Description of the Related Art

In recent years, a copying machine, a printer, or the like has started to be required to have a higher speed and a longer lifetime, and hence a magnetic toner has started to need to be capable of standing longer use than a related-art one. Further, there has been a growing demand for the energy savings of an apparatus, and at the same time, excellent low-temperature fixing performance of the toner has been strongly required for corresponding to the demand.

In general, the low-temperature fixing performance is related to the viscosity of the toner, and hence the property by virtue of which the toner quickly melts with heat at the time of fixation, i.e., the so-called sharp melt property has been required.

As described in Japanese Patent Application Laid-Open No. 2004-138920, there has been proposed a toner containing toner particles each improved in sharp melt property through the incorporation of a crystalline block polyester, in which the surface coverage of each of the toner particles with an external additive is set to as high as 100% or more. Japanese Patent Application Laid-Open No. 2004-138920 proposes that the development stability of the toner be improved by such procedure while its low-temperature fixability is achieved. However, when it is assumed that the copying machine, the printer, or the like has a higher speed and a longer lifetime in the future, it is expected that an external stress such as stirring in its developing unit or an increase in temperature of its main body further strengthens, and hence a reduction in developability, an image defect, or melt adhesion to members occurs owing to the embedding of the external additive. Accordingly, the toner is susceptible to improvement.

With a view to suppressing such embedding, many attempts each involving using an external additive having a large particle diameter have been made to suppress the embedding of the external additive in the surface of the toner and to improve its development durability.

As described in, for example, Japanese Patent Application Laid-Open No. 2002-318467, Japanese Patent Application Laid-Open No. 2005-202131, and Japanese Patent Application Laid-Open No. 2013-92748, it has been proposed that spacer particles be added to suppress the embedding of the external additive and to improve the endurance stability of the toner. However, the addition of those spacer particles is expected to adversely affect the low-temperature fixability of the toner.

Further, it has been known that inorganic fine particles, or organic-inorganic composite fine particles each using a resin having a high crosslinking density as a core resin, to be generally utilized as the spacer particles have a high volumetric specific heat. Accordingly, when a quantity of heat by which the temperature of the external additive can be sufficiently increased is charged into a fixing unit, there is a risk in that the temperature of a toner image after fixation hardly reduces, and hence the phenomenon in which upon lamination of sheets of paper immediately after printing, the sheets of paper adhere to each other, i.e., the so-called adhesion of printed paper occurs.

As described above, in consideration of increases in speed and lifetime of a printer or the like, and the energy savings thereof in the future, a toner having high developability, and excellent in low-temperature fixability and resistance to the adhesion of printed paper is needed. At present, however, there are an extremely large number of technological problems to be solved for such purpose, and the related-art toner is susceptible to improvement.

SUMMARY OF THE INVENTION

An object of the present invention is to provide a magnetic toner that has solved the problems.

Specifically, the object of the present invention is to provide a magnetic toner, which is excellent in endurance stability and low-temperature fixability in high-speed printing, and can satisfactorily suppress the occurrence of the adhesion of printed paper.

According to one embodiment of the present invention, there is provided a magnetic toner, including:

a toner particle each containing a binder resin, a magnetic material, and a releasing agent; and an inorganic fine particle "a" and an organic-inorganic composite fine particle on surface of the toner particle, in which:

the organic-inorganic composite fine particle comprises i) a vinyl-based resin particle and an inorganic fine particle "b" embedded in a vinyl-based resin particle, ii) the organic-inorganic composite fine particle has a volumetric specific heat at 80° C. of 2,900 kJ/($m^3$·° C.) or more and 4,200 kJ/($m^3$·° C.) or less, and iii) the toner contains the organic-inorganic composite fine particle of at 0.5 mass % or more and 3.0 mass % or less with reference to a mass of the toner;

the inorganic fine particle "a" contains at least an inorganic oxide fine particle selected from the group consisting of a silica fine particle, a titanium oxide fine particle, and an alumina fine particle, and has a number-average particle diameter (D1) of 5 nm or more and 25 nm or less;

when a coverage of each of the surface of the toner particle with the inorganic fine particle " " a is represented by A (%), the coverage A is 45.0% or more and 70.0% or less; and the releasing agent includes an ester compound.

Further features of the present invention will become apparent from the following description of exemplary embodiments with reference to the attached drawings.

DESCRIPTION OF THE EMBODIMENTS

Figure 1:
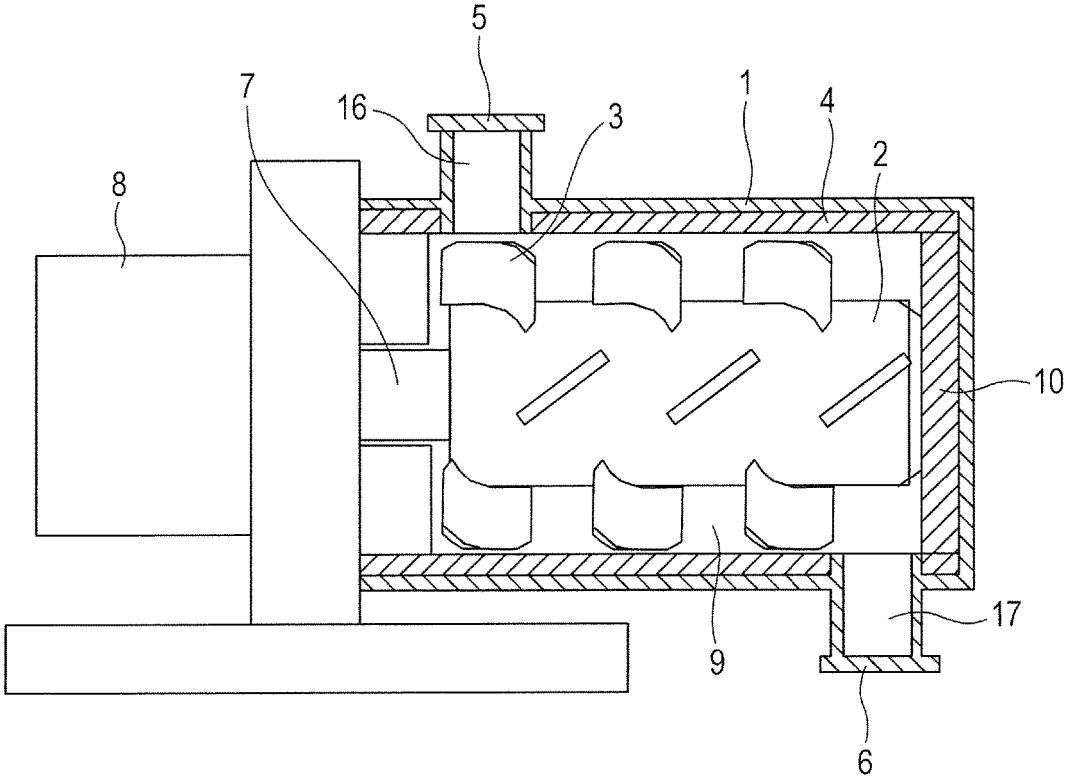
FIG. 1 is a schematic view for illustrating an example of a mixing treatment apparatus that can be used in the external addition and mixing of inorganic fine particles.

Preferred embodiments of the present invention will now be described in detail in accordance with the accompanying drawings.

In order to obtain a toner having good low-temperature fixability, the toner needs to be quickly melted in a short time period for which the toner passes a fixing unit nip. The control of the melting characteristic of a resin component as a main component for the toner has been generally known as an approach to quickly melting the toner.

Meanwhile, the stabilization of developability is required for corresponding to a high-speed printing system. Against that background, a toner that has satisfied such low-temperature fixing performance as described above is weak against an external stress such as stirring in the developing unit of the system or an increase in temperature of the main body thereof, and hence a problem such as the deterioration of the durability of the toner or its adhesion to a member due to the embedding of its external additive is liable to occur.

With a view to suppressing such embedding, it has been known that inorganic fine particles each having a large particle diameter are added as a spacer to suppress the embedding of an external additive in the surface of the toner and to improve its development durability. However, the addition of the inorganic fine particles each having a large particle diameter may affect the low-temperature fixability of the toner. This is expected to be because an increase in particle diameter of the external additive widens an interval between toner particles to inhibit the coalescence of the toner particles or their fixation to paper by the melting of the toner with heat. In addition, in order to cover a certain area of the surface of the toner with the inorganic fine particles each having a large particle diameter, the volume of the external additive to be added increases. In this case, the heat capacity of the entirety of the external additive increases, and hence it becomes difficult to supply thermal energy sufficient for the melting of toner base particles at the time of fixation. This point can also be a factor of a reduction in the low-temperature fixability. Further, those inorganic fine particles each having a large particle diameter have a high volumetric specific heat. Accordingly, when a quantity of heat by which the temperature of the toner can be sufficiently increased is charged into a fixing unit, there is a risk in that the temperature of a toner image after the fixation hardly reduces and hence the adhesion of printed paper occurs. In contrast, resin particles each having a large particle diameter are given as examples of spacer particles having a low volumetric specific heat, but the resin particles generally reduce the flowability of the toner. Accordingly, a uniform charge distribution is not obtained, which may hinder the development stability of the toner.

In view of the foregoing, the inventors of the present invention have made investigations with a view to finding a toner, which is excellent in development stability and low-temperature fixability, and is suppressed in occurrence of the adhesion of printed paper. As a result, the inventors have revealed that the above-mentioned contradiction can be solved by: using a certain amount of specific organic-inorganic composite fine particles; specifying a relationship between the coverage of the surface of a magnetic toner particle with inorganic fine particles and a coverage with the inorganic fine particles fixed to the surface of the magnetic toner particle; and characterizing the kind of a releasing agent to be incorporated into a binder resin.

First, the outline of a magnetic toner of the present invention is described.

In the magnetic toner of the present invention, the sharp melt property of a binder resin is improved. In addition, the improvement in sharp melt property is achieved by incorporating an ester compound as a releasing agent into a magnetic toner particle.

In addition, in the magnetic toner of the present invention, organic-inorganic composite fine particles each having a specific shape and having a specific volumetric specific heat are added in a proper amount for improving its development stability and resistance to the adhesion of printed paper at the time of high-speed printing.

In addition, in the magnetic toner of the present invention, a coverage with inorganic fine particles fixed to the surface of the magnetic toner particle is optimized.

With such magnetic toner, while good development stability was achieved, it became easy to transfer heat to, and escape heat from, the magnetic toner, and hence an improvement in low-temperature fixability and the suppression of the adhesion of printed paper after printing were able to be achieved.

The toner of the present invention contains the ester compound as the releasing agent. When the ester compound is incorporated as the releasing agent, the releasing agent is finely dispersed in the binder resin, and hence a microdomain is formed in the binder resin by the releasing agent. The domain plasticizes the resin, improves the sharp melt property of the toner particle, and improves the low-temperature fixability. However, when the inorganic fine particles are externally added as an external additive to the toner, as described above, an external stress such as stirring in the developing unit of an image-forming apparatus or an increase in temperature of the main body thereof causes a problem such as the deterioration of the durability of the toner or its adhesion to a member due to the embedding of the external additive. In addition, even when inorganic fine particles each having a large particle diameter are added as spacer particles to the toner, there is a risk in that the fine particles roll into the recessed portions of the surface of the toner particle owing to long-term use, and hence sufficient development stability is not obtained during the use of the toner. Further, particles having a high volumetric specific heat are present in the inorganic fine particles, and may cause a problem in the resistance to the adhesion of printed paper. Meanwhile, even when the resistance to the adhesion of printed paper is improved by adding resin particles having a low volumetric specific heat, the resin particles generally reduce the flowability of the toner, and hence the toner may be unable to have stable chargeability.

In view of the foregoing, the inventors of the present invention have made extensive investigations, and as a result, have found that when the organic-inorganic composite fine particles are used as the spacer particles and the ester compound is used as the releasing agent, a large effect is obtained and the problems can be solved.

A reason for the foregoing is unclear, but the inventors have assumed the reason to be as described below.

First, the use of the ester compound as the releasing agent imparts sharp melt property to the binder resin. As described above, when heat is applied to the binder resin in which the ester compound is finely dispersed to form a microdomain, heat absorption behavior at the time of the melting of the toner is completed within an extremely short time period. When the organic-inorganic composite fine particles whose volumetric specific heat has been controlled are externally added to a toner particle using such binder resin, the sharp melt property is maintained and the low-temperature fixability is achieved even in fixation in a high-speed printer. Further, with regard to the cooling rate of the toner on paper after the fixation, the heat generation behavior of the binder resin is completed within a short time period, and hence the resistance to the adhesion of printed paper improves.

Further, in the case where the volumetric specific heat of the organic-inorganic composite fine particles at 80° C. is 2,900 kJ/($m^3$·° C.) or more and 4,200 kJ/($m^3$·° C.) or less, even when the fine particles receive relatively strong physical friction or the like in an electrophotographic process increased in speed and lifetime, the temperature of the toner increases and hence the fine particles are hardly embedded in the surface of a toner base particle. At the time of the fixation, an influence on the melting of the toner particle is small and hence the low-temperature fixability of the toner particle can be satisfactorily maintained. The volumetric specific heat is preferably 3,100 kJ/($m^3$·° C.) or more and 4,200 kJ/($m^3$·° C.) or less because those effects are exhibited in an additionally satisfactory manner.

The volumetric specific heat of the organic-inorganic composite fine particles can be adjusted by changing the kind of the inorganic fine particles or changing the amount of the inorganic fine particles with respect to vinyl-based resin fine particles.

The volumetric specific heat is a heat characteristic value that changes depending on the temperature of a material, but in consideration of a temperature on paper in each of the heat fixing steps of a general printer and copying machine, the inventors of the present invention have considered that 80° C. is an optimum value for representing the thermal change of the toner. Accordingly, in the present invention, a volumetric specific heat at 80° C. is specified.

In addition, the toner contains the organic-inorganic composite fine particle at 0.5 mass % or more and 3.0 mass % or less with reference to the mass of the toner. When the addition number of parts of the organic-inorganic composite fine particles falls within the range, even in an apparatus construction increased in speed and lifetime, sufficient chargeability and sufficient flowability can be imparted to the toner without the inhibition of its low-temperature fixability.

Further, the ester compound to be used as the releasing agent in the present invention is preferably a monofunctional ester compound (having one ester bond in a molecule thereof), or a polyfunctional ester compound having two or more functional groups (having two or more ester bonds in a molecule thereof). Of those, the monofunctional ester compound can easily become linear, and hence compatibility between the ester compound and the binder resin improves, and the low-temperature fixability improves.

Further, when the organic-inorganic composite fine particles whose volumetric specific heat has been controlled are used in toner particles each obtained by incorporating the ester compound into the binder resin, the heat of the toner can be effectively escaped and hence the adhesion of printed paper can be suppressed.

Preferred specific examples of the monofunctional ester compound include: a wax having as a main component a fatty acid ester such as a carnauba wax or a montanic acid ester wax; a wax obtained by deacidifying a fatty acid ester to remove a part or all of its acid components such as a deacidified carnauba wax; a methyl ester compound having a hydroxyl group obtained by, for example, hydrogenation of a vegetable oil and fat; and a saturated fatty acid monoester such as stearyl stearate or behenyl behenate.

Preferred examples of the fatty acid that may be used as a material for the ester compound include stearic acid, behenic acid, myristic acid, palmitic acid, arachidic acid, and lignoceric acid. As an alcohol as a constituent of the ester compound, there are preferably given, for example, stearyl alcohol, behenyl alcohol, arachidyl alcohol, and dipentaerythritol.

The melting point of the releasing agent specified by the peak temperature of the highest endothermic peak at the time of its temperature increase measured with a differential scanning calorimeter (DSC) is preferably from 60° C. to 140° C., more preferably from 60° C. to 90° C. The use of an ester compound having a melting point within the range can improve the low-temperature fixability. Further, as described above, the external addition of organic-inorganic composite fine particles having a specific volumetric specific heat can effectively escape the heat of the toner particles after the fixation, and hence achieve good resistance to the adhesion of printed paper.

Further, the half width of the endothermic peak of the toner particles is preferably 2.0° C. or more and 10.0° C. or less, more preferably 2.0° C. or more and 8.0° C. or less. When the half width of the endothermic peak of the toner particles is controlled to the range, the toner particles can easily melt at the time of the fixation and hence the low-temperature fixability improves. Further, upon sticking of the organic-inorganic composite fine particles to the toner particles, the heat of the toner on paper after the fixation is effectively escaped, and hence the resistance to the adhesion of printed paper improves. Methods of measuring the half width of the endothermic peak of the toner of the present invention and the melting point of the ester compound are described later.

In order to control the endothermic peak heat quantity to the range, the content of the ester compound is preferably 1.0 part by mass or more and 10.0 parts by mass or less with respect to 100 parts by mass of the binder resin. A method of measuring the endothermic peak heat quantity is described later.

When the content of the releasing agent is controlled to the range, the resistance to the adhesion of printed paper and the development durability of the toner can be improved in a state in which the low-temperature fixability is maintained.

In addition, such releasing agent can be incorporated into the binder resin by, for example, a method involving, at the time of the production of the resin, dissolving the resin in a solvent, increasing the temperature of the resin solution, and adding and mixing the releasing agent while stirring the solution, or a method involving adding the releasing agent at the time of melting and kneading during the production of the toner.

In addition, the binder resin to be used in the toner of the present invention is preferably a styrene-based copolymer or a polyester resin because the extent to which the releasing agent is finely dispersed in the binder resin can be easily controlled.

Only one kind or two or more kinds of, for example, the following vinyl monomers are used as a comonomer for a styrene monomer of the styrene-based copolymer: monocarboxylic acids each having a double bond such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide and substitution products thereof; dicarboxylic acids each having a double bond such as maleic acid, butyl maleate, methyl maleate, and dimethyl maleate and substitution products thereof; vinyl esters such as vinyl chloride, vinyl acetate, and vinyl benzoate; ethylene-based olefins such as ethylene, propylene, and butylene; vinyl ketones such as vinyl methyl ketone and vinyl hexyl ketone; and vinyl ethers such as vinyl methyl ether, vinyl ethyl ether, and vinyl isobutyl ether.

Examples of a monomer for controlling the acid value of the binder resin include: an acrylic acid such as acrylic acid, methacrylic acid, α-ethyl acrylate, crotonic acid, cinnamic acid, vinyl acetate, isocrotonic acid, or angelic acid and an α- or β-alkyl derivative thereof; and an unsaturated dicarboxylic acid such as fumaric acid, maleic acid, citraconic acid, an alkenyl succinic acid, itaconic acid, mesaconic acid, dimethylmaleic acid, or dimethylfumaric acid and a monoester derivative or anhydride thereof. A desired polymer can be produced by copolymerizing any one of the monomers or a mixture of the monomers with another monomer. Of those, a monoester derivative of an unsaturated dicarboxylic acid is particularly preferably used to control the acid value.

More specific examples thereof include: monoesters of α- or β-unsaturated dicarboxylic acids such as monomethyl maleate, monoethyl maleate, monobutyl maleate, monooctyl maleate, monoallyl maleate, monophenyl maleate, monomethyl fumarate, monoethyl fumarate, monobutyl fumarate, and monophenyl fumarate; and monoesters of alkenyl dicarboxylic acids such as monobutyl n-butenylsuccinate, monomethyl n-octenylsuccinate, monoethyl n-butenylmalonate, monomethyl n-dodecenylglutarate, and monobutyl n-butenyladipate.

The addition amount of such carboxyl group-containing monomer may be from 0.1 part by mass to 20 parts by mass, preferably from 0.2 part by mass to 15 parts by mass with respect to 100 parts by mass of all monomers constituting the binder resin.

An alcohol and an acid that may be used in the production of the polyester resin to be used as the binder resin are as described below.

As a dihydric alcohol component, there are given: ethylene glycol; propylene glycol; 1,3-butanediol; 1,4-butanediol; 2,3-butanediol; diethylene glycol; triethylene glycol; 1,5-pentanediol; 1,6-hexanediol; neopentyl glycol; 2-ethyl-1,3-hexanediol; hydrogenated bisphenol A; and a bisphenol represented by the formula (A) and a derivative thereof:

(A)

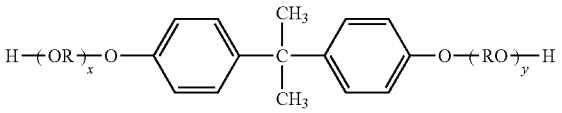

(in the formula, R represents an ethylene or propylene group, x and y each represent an integer of 0 or more, and the average of x+y is from 0 to 10); and diols each represented by the formula (B):

(B)

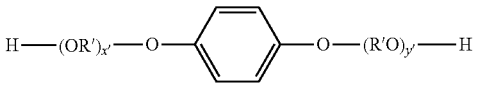

(in the formula, R' represents

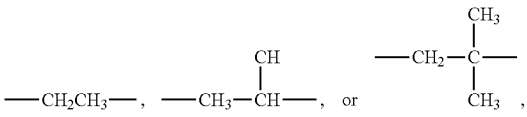

X' and Y' each represent an integer of 0 or more, and the average of X'+Y' is from 0 to 10).

As a divalent acid component, for example, there are given dicarboxylic acids and derivatives thereof such as: benzene dicarboxylic acids or anhydrides thereof such as phthalic acid, terephthalic acid, isophthalic acid, and phthalic anhydride, or lower alkyl esters thereof; alkyldicarboxylic acids or anhydrides thereof such as succinic acid, adipic acid, sebacic acid, and azelaic acid, or lower alkyl esters thereof; alkenylsuccinic acids or alkylsuccinic acids or anhydrides thereof such as n-dodecenylsuccinic acid and n-dodecylsuccinic acid, or lower alkyl esters thereof; and unsaturated dicarboxylic acids or anhydrides thereof such as fumaric acid, maleic acid, citraconic acid, and itaconic acid, or lower alkyl esters thereof.

In addition, an alcohol component, which is trihydric or more and an acid component, which is trivalent or more, the components serving as crosslinking components, are preferably used in combination.

As a polyhydric alcohol component, which is trihydric or more, for example, there are given: sorbitol; 1,2,3,6-hexanetetrol; 1,4-sorbitan; pentaerythritol; dipentaerythritol; tripentaerythritol; 1,2,4-butanetriol; 1,2,5-pentanetriol; glycerol; 2-methyl propanetriol; 2-methyl-1,2,4-butanetriol; trimethylolethane; trimethylolpropane; and 1,3,5-trihydroxybenzene.

As a polyvalent carboxylic acid component, which is trivalent or more in the present invention, for example, there are given polyvalent carboxylic acids and derivatives thereof such as: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, and an enpol trimer acid, and anhydrides and lower alkyl esters thereof; and tetracarboxylic acids each represented by the following formula (C) and anhydrides and lower alkyl esters thereof:

(C)

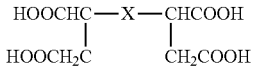

(in the formula, X represents an alkylene or alkenylene group having 5 to 30 carbon atoms and having one or more sides chains each having 3 or more carbon atoms).

The content of the alcohol component to be used in the production of the polyester resin is desirably from 40 mol % to 60 mol %, preferably from 45 mol % to 55 mol % with respect to the total of the alcohol component and the acid component. In addition, the content of a polyvalent component, which is trivalent or more is preferably from 5 mol % to 60 mol % in all components.

The polyester resin is obtained by generally known condensation polymerization.

The acid value of the binder resin is more preferably 5 mgKOH/g or more and 30 mgKOH/g or less. When the acid value is controlled to the range, the releasing agent can be finely dispersed in the binder resin with ease, and hence heat can be effectively escaped from the toner particles after the fixation. In addition, the chargeability can be easily controlled, which exhibits a good effect on the development stability.

In addition, the binder resin has a glass transition temperature (Tg) of preferably from 40° C. to 70° C., more preferably from 50° C. to 70° C. from the viewpoint that compatibility between the low-temperature fixability and storage stability of the toner can be easily achieved. A Tg of 40° C. or more is preferred because the storage stability can easily improve, and a Tg of 70° C. or less is also preferred because the low-temperature fixability tends to improve.

Further, the magnetic toner of the present invention has a feature in that: the toner includes inorganic fine particles a; the inorganic fine particles "a" a contain at least one kind of inorganic oxide fine particle selected from the group consisting of silica, titanium oxide, and alumina, and have a number-average particle diameter (D1) of 5 nm or more and 25 nm or less; and a coverage A of each of the surfaces of the particles of the magnetic toner with the inorganic fine particles is 45.0% or more and 70.0% or less.

The inventors of the present invention have found that the magnetic toner of the present invention can achieve, by adopting the construction, compatibility between its fixability and resistance to the adhesion of printed paper while maintaining its stability at the time of long-term use. The inventors of the present invention have considered a reason for the foregoing to be as described below.

Spacer particles have heretofore been used for suppressing the endurance deterioration of the toner. As described above, those spacer particles exhibit an effect on the embedding of an external additive. However, it has been revealed that when the spacer particles receive an excessive stress, as the time period for which the toner is used lengthens, the spacer particles move to the recessed portions of toner base particles to reduce the effect. In contrast, investigations made by the inventors of the present invention have revealed that the maintenance of a spacer effect at the time of the long-term use is achieved by controlling the shapes of the spacer particles to increase their adhesive forces with the toner base particles. Further, the inventors have found that the spacer of the above-mentioned shape exhibits a higher effect in a toner surface covered to a large extent as compared to a conventional state of coverage with inorganic fine particles. This is assumed to be because the size of the unevenness of the surface of the magnetic toner is alleviated by the coverage with the inorganic fine particles.

As described above, the organic-inorganic composite fine particles are used, and a relationship between the coverage of each of the surfaces of the magnetic toner particles with the inorganic fine particles and a coverage with the inorganic fine particles fixed to each of the surfaces of the magnetic toner particles is specified. Further, the ester compound is incorporated as the releasing agent. Probably as a result of the foregoing, the deterioration of the toner hardly occurs even at the time of the long-term use and the stabilization of an image can be achieved.

Now, the magnetic toner of the present invention is specifically described.

The toner of the present invention has a feature in that the inorganic fine particles "a" and the organic-inorganic composite fine particles are present on each of the surfaces of the toner particles. As described above, the construction is necessary for suppressing the deterioration of the toner even when the time period for which the toner is used is long, and the inorganic fine particles "a" are indispensable for additionally effective expression of the spacer effect. In addition, the organic-inorganic composite fine particles to be used in the present invention have a feature in that the fine particles comprise vinyl-based resin particles and inorganic fine particles "b" embedded in the vinyl-based resin particles. From the viewpoints of the control of the flowability and chargeability of the toner, and the low-temperature fixability, it is necessary that the organic-inorganic composite fine particles each adopt a structure in which the core resin of the fine particle is the vinyl-based resin and part of the inorganic fine particles "b" are embedded in the core resin. The crosslinking density of the vinyl-based resin can be easily controlled, and a resin having a short distance between crosslinking points and a high crosslinking density tends to have a high volumetric specific heat. Accordingly, the adhesion of printed paper is liable to occur. When the fine particles to be utilized as the spacer particles are organic fine particles, the flowability and the chargeability of the toner reduce, and when the fine particles are inorganic fine particles, the fine particles inhibit the fixation to reduce the low-temperature fixability, or the adhesion of printed paper is liable to occur.

Further, the organic-inorganic composite fine particles to be used in the present invention each desirably have, on its surface, a protruded portion derived from the inorganic fine particles "b". The foregoing is a preferred mode in terms of the control of their adhesive forces with the surface of the toner. In addition, the number-average particle diameter of the organic-inorganic composite fine particles is preferably 50 nm or more and 200 nm or less in terms of the suppression of the endurance fluctuation of the toner and the suppression of the contamination of a member.

The organic-inorganic composite fine particles can be produced in accordance with, for example, the description of Examples of WO 2013/063291. The inorganic fine particles "b" to be used in the organic-inorganic composite fine particles, which are not particularly limited, are preferably at least one kind of inorganic oxide particle selected from the group consisting of silica, titanium oxide, and alumina in terms of their adhesion properties with the toner surface.

The magnetic toner of the present invention has a feature in that when the coverage of each of the surfaces of the magnetic toner particles with the inorganic fine particles "a" is represented by a coverage A (%), the coverage A is 45.0% or more and 70.0% or less.

The coverage A of the magnetic toner of the present invention is as high as 45.0% or more. Accordingly, a van der Waals force between the magnetic toner and a member is low, an adhesive force between the magnetic toner particles or between the toner and the member can easily reduce, and the stability of an image at the time of the long-term use can be improved. Further, a reducing effect on the fine unevenness of the toner surface is exhibited.

Meanwhile, when an attempt is made to set the coverage A to more than 70.0%, the inorganic fine particles need to be added in a large amount. At this time, even when a new twist is given to a method for an external addition treatment, heat conduction at the time of the fixation reduces or the releasability of the toner from a fixing film reduces owing to liberated inorganic fine particles, and hence the low-temperature fixability reduces.

Further, the magnetic toner of the present invention is preferably such that when the coverage of each of the surfaces of the toner particles with the inorganic fine particles fixed to the surface of the toner particle is represented by a coverage B (%), the ratio of the coverage B to the coverage A [coverage B/coverage A, hereinafter sometimes simply referred to as "B/A"] is 0.50 or more and 0.85 or less.

The coverage A represents a coverage with particles including particles that can be easily liberated, and the coverage B represents a coverage with inorganic fine particles that are not liberated by a liberating operation to be described later and are fixed to each of the surfaces of the magnetic toner particles. The inorganic fine particles contributing to the calculation of the coverage B are fixed in a semi-embedded state to each of the surfaces of the magnetic toner particles, and even when the magnetic toner receives a shear on a developing sleeve or an electrostatic latent image-bearing member, the migration of the external additive may not occur.

On the other hand, the inorganic fine particles contributing to the calculation of the coverage A include the fixed inorganic fine particles and inorganic fine particles present above the fine particles, the latter fine particles each having a relatively high degree of freedom.

A state in which the B/A is 0.50 or more and 0.85 or less means that inorganic fine particles fixed to the surface of the magnetic toner are present to some extent, and inorganic fine particles are further present in a proper amount in a state of being capable of being easily liberated (in a state of being capable of behaving away from the magnetic toner particles) above the fixed fine particles. Probably, the inorganic fine particles that can be liberated slide with respect to the fixed inorganic fine particles to exhibit an effect like a bearing (hereinafter sometimes referred to as "bearing effect"), thereby significantly reducing a cohesive force between the magnetic toner particles. Accordingly, as described in the foregoing, the surface of an unfixed image can be smoothened to be brought into a state close to closest packing, and hence heat from a fixing unit can be uniformly and efficiently applied to the magnetic toner. In addition, the bearing effect eliminates an excessive stress on the magnetic toner, and hence the image stability at the time of the long-term use significantly improves.

Investigations made by the inventors of the present invention have found that the adhesive force-reducing effect and bearing effect to be obtained become maximum in the case of the following construction. That is, the number-average particle diameter (D1) of the inorganic fine particles "a" including the fixed inorganic fine particles and the inorganic fine particles that can be easily liberated needs to be 5 nm or more and 25 nm or less.

Further, it is preferred that 85 mass % or more of the inorganic oxide fine particles be silica fine particles, and it is more preferred that 90 mass % or more of the fine particles be silica fine particles. This is because the silica fine particles not only strike the most excellent balance between the impartment of the chargeability and the impartment of the flowability but also are excellent in terms of a reduction in cohesive force between the toner particles.

When the number-average particle diameter (D1) of the primary particles of the inorganic fine particles "a" falls within the range, the coverage A and the B/A can be properly controlled with ease, and hence the adhesive force-reducing effect and the bearing effect are obtained.

The inorganic fine particles "a" to be used in the present invention are preferably subjected to a hydrophobic treatment, and are particularly preferably subjected to the hydrophobic treatment so that the degree of hydrophobicity of each of the fine particles measured by a methanol titration test may be 40% or more, more preferably 50% or more.

As a method for the hydrophobic treatment, there is given a method involving treating the inorganic fine particles with an organosilicon compound, a silicone oil, a long-chain fatty acid, or the like.

Examples of the organosilicon compound include hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. One kind of those compounds may be used alone, or two or more kinds thereof may be used as a mixture.

Examples of the silicone oil include dimethyl silicone oil, methylphenyl silicone oil, α-methylstyrene-modified silicone oil, chlorophenyl silicone oil, and fluorine-modified silicone oil.

A fatty acid having 10 to 22 carbon atoms can be suitably used as the long-chain fatty acid, and the acid may be a linear fatty acid or may be a branched fatty acid. In addition, each of a saturated fatty acid and an unsaturated fatty acid can be used.

Of those, a linear saturated fatty acid having 10 to 22 carbon atoms is extremely preferred because the surfaces of the inorganic fine particles can be uniformly treated with the acid with ease.

Examples of the linear saturated fatty acid include caprylic acid, lauric acid, myristic acid, palmitic acid, stearic acid, arachidic acid, and behenic acid.

The inorganic fine particles to be used in the present invention are preferably treated with a silicone oil, and the inorganic fine particles are more preferably treated with an organosilicon compound and the silicone oil. This is because the degree of hydrophobicity can be suitably controlled.

Examples of a method of treating the inorganic fine particles with the silicone oil include: a method involving directly mixing the inorganic fine particles, which have been treated with the organosilicon compound, and the silicone oil with a mixer such as a Henschel mixer; and a method involving spraying the inorganic fine particles with the silicone oil. Alternatively, the following method is permitted: after the silicone oil has been dissolved or dispersed in a proper solvent, the inorganic fine particles are added to the resultant, and the contents are mixed, followed by the removal of the solvent.

The amount of the silicone oil with which the inorganic fine particles are treated is preferably 1 part by mass or more and 40 parts by mass or less, more preferably 3 parts by mass or more and 35 parts by mass or less with respect to 100 parts by mass of the inorganic fine particles in order to obtain good hydrophobicity.

Silica fine particles, titania fine particles, and alumina fine particles each have a specific surface area measured by a BET method based on nitrogen adsorption (BET specific surface area) of preferably 20 $m^2/g$ or more and 350 $m^2/g$ or less, more preferably 25 $m^2/g$ or more and 300 $m^2/g$ or less because good flowability can be imparted to the magnetic toner.

The measurement of the specific surface area measured by the BET method based on nitrogen adsorption (BET specific surface area) is performed in conformity with JIS Z 8830 (2001). Used as a measuring apparatus is an "automatic specific surface area/pore distribution-measuring apparatus TriStar3000 (manufactured by Shimadzu Corporation)" adopting a gas adsorption method based on a constant volume method as a measuring system.

In addition, in the present invention, the coefficient of variation of the coverage A between the toner particles is preferably 10.0% or less, more preferably 8.0% or less. A state in which the coefficient of variation is 10.0% or less means that the coverages A of the magnetic toner particles are extremely uniform and the coverage A in each of the magnetic toner particles is also extremely uniform.

A coefficient of variation of the coverage A of 10.0% or less is preferred because of the following reason: as described in the foregoing, the inorganic fine particles fixed after passage through a fixing nip can be present on the surface of a fixed image in an additionally uniform manner, and hence the releasability from the fixing film can be easily exhibited to an additionally large extent.

An approach to setting the coefficient of variation of the coverage A to 10.0% or less is not particularly limited, but such an external addition apparatus or approach as described later by which metal oxide fine particles such as silica fine particles can be diffused on the surfaces of the magnetic toner particles to a high degree is preferably used.

With regard to the coverage with the inorganic fine particles, a theoretical coverage can be calculated from a calculation formula described in, for example, Japanese Patent Application Laid-Open No. 2007-293043 by hypothesizing that the inorganic fine particles and the magnetic toner have true spherical shapes. In many cases, however, the inorganic fine particles and the magnetic toner do not have true spherical shapes. Further, the inorganic fine particles are present in a state of agglomerating on the surfaces of the toner particles in some cases. Accordingly, the theoretical coverage derived by such approach is not related to the present invention.

In view of the foregoing, the inventors of the present invention have determined the coverage of each of the surfaces of the magnetic toner particles actually covered with the inorganic fine particles by observing the surface of the magnetic toner with a scanning electron microscope (SEM).

As an example, the theoretical coverage and actual coverage of a product obtained by mixing 100 parts by mass of magnetic toner particles produced by a pulverization method having a volume-average particle diameter (Dv) of 8.0 μm (the content of a magnetic material is 43.5 mass %) with silica fine particles while changing their addition amount (addition number of parts of silica) are determined. It should be noted that silica fine particles having a volume-average particle diameter (Dv) of 15 nm are used as the silica fine particles.

In addition, upon calculation of the theoretical coverage, the true specific gravity of the silica fine particles is set to 2.2 $g/cm^3$ and the true specific gravity of the magnetic toner is set to 1.65 $g/cm^3$, and the silica fine particles and the magnetic toner particles are defined as monodisperse particles having an average particle diameter of 15 nm and monodisperse particles having an average particle diameter of 8.0 μm, respectively.

In addition, investigations made by the inventors of the present invention have found that even when the addition amount of the silica fine particles is the same, the coverage changes depending on an approach to the external addition. That is, it is impossible to unambiguously determine the coverage from the addition amount of the silica fine particles.

Because of such reason, the inventors of the present invention have used the coverage with the inorganic fine particles obtained by the observation of the surface of the magnetic toner with a SEM.

In the present invention, as a magnetic material in the magnetic toner, there are given: iron oxides such as magnetite, maghemite, and ferrite; and metals such as iron, cobalt, and nickel, and alloys and mixtures of these metals with metals such as aluminum, copper, magnesium, tin, zinc, beryllium, calcium, manganese, selenium, titanium, tungsten, and vanadium.

The number-average particle diameter (D1) of the primary particles of the magnetic material is preferably 0.50 μm or less, more preferably from 0.05 μm to 0.30 μm.

In addition, with regard to the magnetic characteristics of the magnetic material upon application of 795.8 kA/m, its coercive force (Hc) is preferably from 1.6 kA/m to 12.0 kA/m, its intensity of magnetization (σs) is preferably from 50 $Am^2/kg$ to 200 $Am^2/kg$, more preferably from 50 $Am^2/kg$ to 100 $Am^2/kg$, and its residual magnetization (σr) is preferably from 2 $Am^2/kg$ to 20 $Am^2/kg$.

The magnetic toner of the present invention preferably contains 35 mass % or more and 50 mass % or less of the magnetic material, and more preferably contains 40 mass % or more and 50 mass % or less of the magnetic material.

When the content of the magnetic material in the magnetic toner is less than 35 mass %, the following tendency is observed: the magnetic attraction of the toner with a magnet roll in a developing sleeve reduces and hence fogging occurs.

On the other hand, when the content of the magnetic material is more than 50 mass %, the developability of the toner tends to reduce.

It should be noted that the content of the magnetic material in the magnetic toner can be measured with, for example, a thermal analyzer TGA Q5000IR manufactured by PerkinElmer. A measurement method is as follows: under a nitrogen atmosphere, the magnetic toner is heated from normal temperature to 900° C. at a rate of temperature increase of 25° C./min, a mass reduced in the range of from 100° C. to 750° C. is defined as the mass of a component remaining after the removal of the magnetic material from the magnetic toner, and the remaining mass is defined as the amount of the magnetic material.

A charge control agent is preferably added to the magnetic toner of the present invention. It should be noted that the magnetic toner of the present invention is preferably a negatively chargeable toner.

An organometallic complex compound or a chelate compound is effective as a charge control agent for negative charging, and examples thereof include: monoazo metal complex compounds; acetylacetone metal complex compounds; and metal complex compounds of aromatic hydroxycarboxylic acids or aromatic dicarboxylic acids.

As specific examples of commercially available charge control agents, there are given Spilon Black TRH, T-77, T-95 (manufactured by Hodogaya Chemical Co., Ltd.), and BONTRON (trademark) S-34, S-44, S-54, E-84, E-88, E-89 (manufactured by Orient Chemical Industries Co., Ltd.).

One kind of those charge control agents may be used alone, or two or more kinds thereof may be used in combination. The usage amount of such charge control agent is preferably from 0.1 part by mass to 10.0 parts by mass, more preferably from 0.1 part by mass to 5.0 parts by mass per 100 parts by mass of the binder resin in terms of the charge quantity of the magnetic toner.

In addition to the inorganic fine particles, particles having a number-average particle diameter (D1) of primary particles of 80 nm or more and 3 μm or less may be added to the magnetic toner of the present invention. For example, a lubricant such as fluorine resin powder, zinc stearate powder, or polyvinylidene fluoride powder, or an abrasive such as cerium oxide powder, silicon carbide powder, or strontium titanate powder can be used in such a small amount that the effects are not affected.

The magnetic toner of the present invention has a weight-average particle diameter (D4) of preferably 6.0 μm or more and 10.0 μm or less, more preferably 7.0 μm or more and 9.0 μm or less from the viewpoint of balance between its developability and fixability.

In addition, the magnetic toner of the present invention has an average circularity of preferably 0.935 or more and 0.955 or less, more preferably 0.938 or more and 0.950 or less from the viewpoint of the suppression of its charge-up.

The average circularity of the magnetic toner of the present invention can be adjusted to the range by the adjustment of a production method and production condition for the magnetic toner.

An example of the method of producing the magnetic toner of the present invention is given below, but the method is not limited thereto.

The method of producing the magnetic toner of the present invention only needs to enable the adjustment of the coverage A and the B/A, and preferably includes the step of adjusting the average circularity. The other production steps thereof are not particularly limited, and hence the toner can be produced by a known method.

The following method can be suitably given as an example of such production method. First, the binder resin and the magnetic material, and as required, other materials such as the releasing agent and the charge control agent are sufficiently mixed with a mixer such as a Henschel mixer or a ball mill. Then, the mixture is melted, mulled, and kneaded with a heat kneader such as a roll, a kneader, or an extruder so that resins may be made compatible with each other.

The resultant molten kneaded product is cooled and solidified, and then the solidified product is coarsely pulverized, finely pulverized, and classified. The external additive such as the inorganic fine particles is externally added and mixed in the resultant magnetic toner particles. Thus, the magnetic toner can be obtained.

Examples of the mixer include: Henschel mixer (manufactured by Nippon Coke & Engineering Co., Ltd.); Super Mixer (manufactured by Kawata Mfg Co., Ltd.); Ribocone (manufactured by Okawara Corporation); Nauta Mixer, Turburizer, Cyclomix, and Nobilta (manufactured by Hosokawa Micron); Spiral Pin Mixer (manufactured by Pacific Machinery & Engineering Co., Ltd.); and Loedige Mixer (manufactured by Matsubo Corporation).

Examples of the kneader include: KRC kneader (manufactured by Kurimoto Ironworks Co., Ltd.); Buss Co-kneader (manufactured by Buss Co., Ltd.), TEM-type extruder (manufactured by Toshiba Machine Co., Ltd.); TEX Biaxial Kneader (manufactured by The Japan Steel Works, Ltd.); PCM Kneader (manufactured by Ikegai machinery Co.); Three-Roll Mill, Mixing Roll Mill, and Kneader (manufactured by Inoue Manufacturing Co., Ltd.); Kneadex (manufactured by Nippon Coke & Engineering Co., Ltd.); MS-type Pressure Kneader, and Kneader-Ruder (manufactured by Moriyama Manufacturing Co., Ltd.); and Banbury Mixer (manufactured by Kobe Steel, Ltd.).

Examples of the pulverizer include: Counter Jet Mill, Micron Jet, and Inomizer (manufactured by Hosokawa Micron); IDS-type Mill and PJM Jet Mill (manufactured by Nippon Pneumatic Mfg Co., Ltd.); Cross Jet Mill (manufactured by Kurimoto Tekkosho KK); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd.); Turbo Mill (manufactured by Turbo Kogyo Co., Ltd.); and Super Rotor (manufactured by Nisshin Engineering Inc.).

The average circularity can be controlled by using the Turbo Mill out of those apparatus and adjusting an exhaust gas temperature at the time of the fine pulverization. When the exhaust gas temperature is set to a low value (e.g., 40° C. or less), a value for the average circularity reduces, and when the exhaust gas temperature is set to a high value (e.g., around 50° C.), the value for the average circularity increases.

Examples of the classifier include: Classiel, Micron Classifier, and Spedic Classifier (manufactured by Seishin Enterprise Co., Ltd.); Turbo Classifier (manufactured by Nisshin Engineering Inc.); Micron Separator, Turboprex (ATP), and TSP Separator (manufactured by Hosokawa Micron); Elbow Jet (manufactured by Nittetsu Mining Co., Ltd.); Dispersion Separator (manufactured by Nippon Pneumatic Mfg Co., Ltd.); and YM Microcut (manufactured by Yasukawa Shoji K.K.).

As a sifter for sieving coarse particles and the like, there are given: Ultra Sonic (manufactured by Koei Sangyo Co., Ltd.); Rezona Sieve and Gyro Sifter (manufactured by Tokuju Corporation); Vibrasonic System (manufactured by Dalton Co., Ltd.); Sonicreen (manufactured by Shinto Kogyo K.K.); Turbo Screener (manufactured by Turbo Kogyo Co., Ltd.); Microsifter (manufactured by Makino Mfg. Co., Ltd.); and circular vibrating sieves.

A known mixing treatment apparatus such as the mixer can be used as a mixing treatment apparatus for externally adding and mixing the inorganic fine particles, but such an apparatus as illustrated in FIG. 1 is preferred because the apparatus can easily control the coverage A, the B/A, and the coefficient of variation of the coverage A.

FIG. 1 is a schematic view for illustrating an example of a mixing treatment apparatus that can be used upon external addition and mixing of the inorganic fine particles to be used in the present invention.

The mixing treatment apparatus can easily stick the inorganic fine particles to the surfaces of the magnetic toner particles because the apparatus has a construction in which a shear is applied to the magnetic toner particles and the inorganic fine particles in a narrow clearance portion.

Next, methods of measuring respective physical properties according to the present invention are described. Examples to be described later are also based on the methods.

<Method of determining Inorganic Fine Particles>

(1) Determination of Content of Silica Fine Particles in Magnetic Toner (Standard Addition Method)

3 Grams of a magnetic toner is loaded into an aluminum ring having a diameter of 30 mm, and a pressure of 10 tons is applied thereto to produce a pellet. The intensity of silicon (Si) is determined by wavelength-dispersive fluorescent X-ray analysis (XRF) (Si intensity-1). It should be noted that measurement conditions only need to be optimized for an XRF apparatus to be used, but all series of intensity measurements are performed under the same conditions. Silica fine particles having a number-average particle diameter of primary particles of 12 nm are added to the magnetic toner at 1.0 mass % with respect to the magnetic toner, and the contents are mixed with a coffee mill.

At this time, the silica fine particles to be mixed can be used without any influence on the determination as long as their number-average particle diameter of primary particles is 5 nm or more and 50 nm or less.

After the mixing, the mixture is pelletized in the same manner as in the foregoing, and then the intensity of Si is determined in the same manner as in the foregoing (Si intensity-2). The same operations are performed on samples each obtained by adding and mixing 2.0 mass % or 3.0 mass % of the silica fine particles to the magnetic toner to determine the intensities of Si (Si intensity-3, Si intensity-4). A silica content (mass %) in the magnetic toner is calculated by a standard addition method through the use of the Si intensities-1 to 4. It should be noted that the measurement method is limited to the case where one kind of silica is used because in the case where a plurality of kinds of silica of the inorganic fine particles "a" are added, Si intensities corresponding to the plurality of kinds are detected in XRF.

A titania content (mass %) and alumina content (mass %) in the magnetic toner are determined by the standard addition method as in the determination of the silica content. That is, the titania content (mass %) can be determined by: adding and mixing titania fine particles having a number-average particle diameter of primary particles of 5 nm or more and 50 nm or less; and determining a titanium (Ti) intensity. The alumina content (mass %) can be determined by: adding and mixing alumina fine particles having a number-average particle diameter of primary particles of 5 nm or more and 50 nm or less; and determining an aluminum (Al) intensity.

(2) Separation of Inorganic Fine Particles from Magnetic Toner Particles

5 Grams of the magnetic toner is weighed in a 200-ml lidded polymer cup with a precision balance, and 100 ml of methanol is added to the cup, followed by dispersion with an ultrasonic dispersing machine for 5 minutes. The magnetic toner is attracted with a neodymium magnet and the supernatant is disposed of. After an operation involving the dispersion with methanol and the disposal of the supernatant has been repeated three times, 100 ml of 10% NaOH and several drops of "CONTAMINON N" (10 mass % aqueous solution of a neutral detergent for washing a precision measuring unit having a pH of 7, the detergent being formed of a nonionic surfactant, an anionic surfactant, and an organic builder, manufactured by Wako Pure Chemical Industries, Ltd.) are added to the residue, and the contents are lightly mixed, followed by standing for 24 hours. After that, the separation is performed with the neodymium magnet again. It should be noted that at this time, rinsing with distilled water is repeated so that NaOH may not remain. Recovered particles are sufficiently dried with a vacuum dryer to provide particles A. The externally added silica fine particles are dissolved and removed by the foregoing operations. The titania fine particles and the alumina fine particles can remain in the particles A because the fine particles are hardly soluble in 10% NaOH.

When the toner contains the silica fine particles as the inorganic fine particles "a" and contains an external additive containing silica, the content of the inorganic fine particles can be obtained by: subjecting the recovered aqueous solution to a centrifuge to fractionate the inorganic fine particles and the external additive depending on their difference in specific gravity; then removing the solvent; sufficiently drying the residue with a vacuum dryer; and measuring the weight of the dried product.

(3) Measurement of Si Intensity in Particles A

3 Grams of the particles A are loaded into an aluminum ring having a diameter of 30 mm, and a pressure of 10 tons is applied thereto to produce a pellet. The intensity of Si is determined by wavelength-dispersive XRF (Si intensity-5). A silica content (mass %) in the particles A is calculated by utilizing the Si intensity-5, and the Si intensities-1 to 4 used in the determination of the silica content in the magnetic toner.

(4) Separation of Magnetic Material from Magnetic Toner

100 Milliliters of tetrahydrofuran is added to 5 g of the particles A, and the contents are mixed well, followed by ultrasonic dispersion for 10 minutes. Magnetic particles are attracted with a magnet and the supernatant is disposed of. This operation is repeated five times. Thus, particles B are obtained. Organic components such as a resin except the magnetic material can be removed by the operation in a substantially complete manner. However, tetrahydrofuran-insoluble matter in the resin may remain, and hence the remaining organic components are preferably burnt by heating the particles B obtained by the operation to 800° C. Particles C obtained after the heating can be approximated to the incorporated magnetic material.

A magnetic material content W (mass %) in the magnetic toner can be obtained by measuring the mass of the particles C. At this time, the mass of the particles C is multiplied by 0.9666 ($Fe_2O_3 \rightarrow Fe_3O_4$) in order to correct an increase in weight of the magnetic material by its oxidation.

(5) Measurement of Ti Intensity and Al Intensity in Separated Magnetic Material

Titania and alumina contents in the magnetic material are calculated by converting a Ti intensity and an Al intensity, which are detected by the FP determination method of wavelength-dispersive XRF as a result of the incorporation of titania and alumina as impurities or additives into the magnetic material, into titania and alumina, respectively.

The amount of the externally added silica fine particles, the amount of the externally added titania fine particles, and the amount of the externally added alumina fine particles are calculated through substitution of the quantitative value obtained by each of the approaches into the following equations.

Amount of externally added silica fine particles(mass %)=silica content(mass %)in magnetic toner−silica content(mass %)in particles A Amount of externally added titania fine particles (mass %)=titania content(mass %)in magnetic toner−{titania content(mass %)in magnetic materialxmagnetic material content W/100}

Amount of externally added alumina fine particles (mass %)=alumina content(mass %)in magnetic toner−{alumina content(mass %)in magnetic materialxmagnetic material content W/100}

(6) Calculation of Ratio of Silica Fine Particles in Metal Oxide Fine Particles Selected from Group Consisting of Silica Fine Particles, Titania Fine Particles, and Alumina Fine Particles in Inorganic Fine Particles Fixed to Each of Surfaces of Magnetic Toner Particles The ratio of the silica fine particles in metal oxide fine particles can be calculated by: drying the toner after the performance of the operation "Removal of Inorganic Fine Particles that are not fixed" in a method of calculating the coverage B to be described later; and then performing the same operations as those of the methods (1) to (5).

<Method of Measuring Number-average Particle Diameter of Primary Particles of Inorganic Fine Particles>

The measurement of the number-average particle diameter of an external additive is performed with a scanning electron microscope "S-4800" (trade name; manufactured by Hitachi Ltd.). A toner to which an external additive has been externally added is observed, the long diameters of 100 primary particles of the external additive are randomly measured in a field of view magnified by a factor of up to 200,000, and their number-average particle diameter is determined. An observation magnification is appropriately adjusted depending on the size of the external additive.

<Calculation of Coverage A>

The coverage A in the present invention is calculated by analyzing an image of the surface of the magnetic toner, which has been photographed with a Hitachi ultra-high resolution field-emission scanning electron microscope S-4800 (Hitachi High-Technologies Corporation), with image analysis software Image-Pro Plus ver. 5.0 (Nippon Roper K.K.). Conditions under which the image is photographed with the S-4800 are as described below.

(1) Sample Production

A conductive paste is applied in a thin manner to a sample stage (aluminum sample stage measuring 15 mm by 6 mm) and the top of the paste is sprayed with the magnetic toner. Further, air blowing is performed to remove an excess magnetic toner from the sample stage and to dry the remaining toner sufficiently. The sample stage is set in a sample holder and the height of the sample stage is regulated to 36 mm with a sample height gauge.

(2) Setting of Conditions for Observation with S-4800

The calculation of the coverage A is performed with an image obtained by observing a reflected electron image with the S-4800. The reflected electron image is reduced in charge-up of the inorganic fine particles as compared to a secondary electron image, and hence the coverage A can be measured with high accuracy.

Liquid nitrogen is poured into an anti-contamination trap mounted to the housing of the S-4800 until the liquid overflows, and the trap is left for 30 minutes. The "PC-SEM" of the S-4800 is activated to perform flushing (the cleaning of a FE chip as an electron source). The acceleration voltage display portion of a control panel on a screen is clicked and a [Flushing] button is pressed to open a flushing execution dialog. After it has been confirmed that a flushing intensity is 2, the flushing is executed. It is confirmed that an emission current by the flushing is from 20 μA to 40 μA. The sample holder is inserted into the sample chamber of the housing of the S-4800. [Origin] on the control panel is pressed to move the sample holder to an observation position.

The acceleration voltage display portion is clicked to open a HV setting dialog, and an acceleration voltage and the emission current are set to [0.8 kV] and [20 μA], respectively. In the [Basic] tab of an operation panel, signal selection is placed in [SE], and [Upper (U)] and [+BSE] are selected for a SE detector. In the right selection box of [+BSE], [L.A. 100] is selected to set a mode in which observation is performed with a reflected electron image. Similarly, in the [Basic] tab of the operation panel, the probe current, focus mode, and WD of an electronic optical system condition block are set to [Normal], [UHR], and [3.0 mm], respectively. The [ON] button of the acceleration voltage display portion of the control panel is pressed to apply the acceleration voltage.

(3) Calculation of Number-average Particle Diameter (D1) of Magnetic Toner

The inside of the magnification display portion of the control panel is dragged to set a magnification to 5,000 (5 k). The focus knob [COARSE] of the operation panel is rotated, and after some degree of focusing has been achieved, aperture alignment is adjusted. The [Align] of the control panel is clicked to display an alignment dialog and [Beam] is selected. The STIGMA/ALIGNMENT knob (X, Y) of the operation panel is rotated to move a beam to be displayed to the center of a concentric circle. Next, [Aperture] is selected and the STIGMA/ALIGNMENT knob (X, Y) is rotated one by one to perform focusing so that the movement of an image may be stopped or minimized. The aperture dialog is closed and focusing is performed by autofocusing. Focusing is performed by further repeating the foregoing operations twice.

After that, the particle diameters of 300 magnetic toner particles are measured and their number-average particle diameter (D1) is determined. It should be noted that the particle diameter of each of the magnetic toner particles is the maximum diameter upon observation of the particle.

(4) Focus Adjustment

In a state in which the middle point of the maximum diameter of particles each having a particle diameter of the number-average particle diameter (D1) obtained in the section (3)±0.1 μm is matched with the center of a measurement screen, the inside of the magnification display portion of the control panel is dragged to set the magnification to 10,000 (10 k). The focus knob [COARSE] of the operation panel is rotated, and after some degree of focusing has been achieved, the aperture alignment is adjusted. The [Align] of the control panel is clicked to display the alignment dialog and [Beam] is selected. The STIGMA/ALIGNMENT knob (X, Y) of the operation panel is rotated to move the beam to be displayed to the center of the concentric circle. Next, [Aperture] is selected and the STIGMA/ALIGNMENT knob (X, Y) is rotated one by one to perform focusing so that the movement of the image may be stopped or minimized. The aperture dialog is closed and focusing is performed by autofocusing. After that, the magnification is set to 50,000 (50 k), focus adjustment is performed with the focus knob and the STIGMA/ALIGNMENT knob in the same manner as in the foregoing, and focusing is performed again by autofocusing. Focusing is performed by repeating the foregoing operations again. Here, when the tilt angle of a surface to be observed is large, the accuracy with which the coverage is measured is liable to reduce. Accordingly, a toner particle whose surface has as small a tilt as possible is selected and analyzed by selecting such a toner particle that the entire surface to be observed is simultaneously in focus upon focus adjustment.

(5) Image Storage

Brightness adjustment is performed according to an ABC mode, and a photograph is taken at a size of 640×480 pixels and stored. The following analysis is performed with the image file. One photograph is taken for one magnetic toner particle and images are obtained for at least 30 magnetic toner particles.

(6) Image Analysis

In the present invention, the coverage A is calculated by subjecting the image obtained by the approach described above to binary coded processing with the following analysis software. At this time, the one screen is divided into 12 squares and each square is analyzed. It should be noted that when an inorganic fine particle having a particle diameter of 50 nm or more is present in a divided section, the calculation of the coverage A is not performed in the section.

Analysis conditions for the image analysis software Image-Pro Plus ver. 5.0 are as described below. Software: Image-Pro Plus 5.1J "Count/size" and "Options" are selected from the "Measure" of a tool bar in the stated order to set binarization conditions. "8-Connect" is selected in an object extraction option and smoothing is set to 0. In addition, "Pre-Filter," "Fill Holes", and "Convex Hull" are not selected, and "Clean Borders" is set to "None". "Select Measurements" is selected from the "Measure" of the tool bar and "2 to $10^7$" is input to an area filter range.

The coverage is calculated by surrounding a square region. At this time, the surrounding is performed so that the area (C) of the region may be from 24,000 pixels to 26,000 pixels. Auto-binarization is performed by "Process"-binarization to calculate the total sum (D) of the areas of silica-free regions.

A coverage a is determined from the area C of the square region and the total sum D of the areas of the silica-free regions by using the following equation.

$$\text{Coverage } a(\%)=100-C/D\times 100$$

As described above, the calculation of the coverage a is performed for 30 or more magnetic toner particles. The average of all obtained data is defined as the coverage A in the present invention.

<Coefficient of Variation of Coverage A>

The coefficient of variation of the coverage A in the present invention is determined as described below. When the standard deviation of all coverage data used in the calculation of the coverage A is represented by σ(A), the coefficient of variation of the coverage A is given by the following equation.

$$\text{Coefficient of variation}(\%)=\{\sigma(A)/A\}\times 100$$

<Calculation of Coverage B>

The coverage B is calculated by first removing the inorganic fine particles that are not fixed to the surface of the magnetic toner and then performing the same operations as those in the calculation of the coverage A.

(1) Removal of Inorganic Fine Particles that are not Fixed

The removal of the inorganic fine particles that are not fixed is performed as described below. The inventors of the present invention have studied and determined conditions for the removal for sufficiently removing fine particles except the inorganic fine particles embedded in the toner surface.

More specifically, 16.0 g of water and 4.0 g of CONTAMINON N (neutral detergent manufactured by Wako Pure Chemical Industries, Ltd., product No. 037-10361) are loaded into a 30-ml vial made of a glass and sufficiently mixed. 1.50 Grams of the magnetic toner is loaded into the produced solution, and a magnet is brought close to the vial from its bottom surface to sink all the magnetic toner. After that, the magnet is moved to remove air bubbles and to conform the magnetic toner to the solution.

An ultrasonic vibrator UH-50 (manufactured by SMT Corporation, using a titanium alloy tip having a tip diameter of 6 mm) is set so that its tip may be positioned at the central portion of the vial and may have a height of 5 mm from the bottom surface of the vial, followed by the removal of the inorganic fine particles by ultrasonic dispersion. After an ultrasonic wave has been applied for 30 minutes, all amount of the magnetic toner is removed and dried. At this time, the quantity of heat to be applied is reduced to the extent possible, and vacuum drying is performed at 30° C. or less.

(2) Calculation of Coverage B

The coverage of the magnetic toner after the drying is calculated in the same manner as in the coverage A. Thus, the coverage B is obtained.

<Methods of measuring Weight-Average Particle Diameter (D4) and Particle Size Distribution of Magnetic Toner>

The weight-average particle diameter (D4) of the magnetic toner is calculated as described below. A precision particle size distribution measuring apparatus based on a pore electrical resistance method provided with a 100-μm aperture tube "Coulter Counter Multisizer 3" (trademark, manufactured by Beckman Coulter, Inc.) is used as a measurement apparatus. Dedicated software "Beckman Coulter Multisizer 3 Version 3.51" (manufactured by Beckman Coulter, Inc.) included with the apparatus is used for setting measurement conditions and analyzing measurement data. It should be noted that the measurement is performed at a number of effective measurement channels of 25,000.

An electrolyte aqueous solution prepared by dissolving reagent grade sodium chloride in ion-exchanged water to have a concentration of about 1 mass %, for example, "ISOTON II" (manufactured by Beckman Coulter, Inc.) can be used in the measurement.

It should be noted that the dedicated software is set as described below prior to the measurement and the analysis.

In the "Change Standard Measurement Method (SOM)" screen of the dedicated software, the total count number of a control mode is set to 50,000 particles, the number of times of measurement is set to 1, and a value obtained by using "Standard Particles each having a Particle Diameter of 10.0 μm" (manufactured by Beckman Coulter, Inc.) is set as a Kd value. A threshold and a noise level are automatically set by pressing a "Threshold/noise Level Measurement" button. In addition, a current is set to 1,600 μA, a gain is set to 2, and an electrolyte solution is set to ISOTON II, and a check mark is placed in a check box "Flush Aperture Tube after Measurement."

In the "Setting for Conversion from Pulse to Particle Diameter" screen of the dedicated software, a bin interval is set to a logarithmic particle diameter, the number of particle diameter bins is set to 256, and a particle diameter range is set to the range of 2 μm to 60 μm.

A specific measurement method is as described below.

(1) About 200 ml of the electrolyte aqueous solution is charged into a 250-ml round-bottom beaker made of glass dedicated for Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "Aperture Flush" function of the dedicated software.

(2) About 30 ml of the electrolyte aqueous solution is charged into a 100-ml flat-bottom beaker made of glass. About 0.3 ml of a diluted solution prepared by diluting "CONTAMINON N" (10 mass % aqueous solution of a neutral detergent for washing a precision measuring unit having a pH of 7, the detergent being formed of a nonionic surfactant, an anionic surfactant, and an organic builder, manufactured by Wako Pure Chemical Industries, Ltd.) with ion-exchanged water by about three mass fold is added as a dispersant to the electrolyte aqueous solution.

(3) An ultrasonic dispersing unit "Ultrasonic Dispersion System Tetora 150" (manufactured by Nikkaki Bios Co., Ltd.) in which two oscillators each having an oscillatory frequency of 50 kHz are built so as to be out of phase by 180° and which has an electrical output of 120 W is prepared. Approximately 3.3 l of ion-exchanged water is charged into the water tank of the ultrasonic dispersing unit. About 2 ml of CONTAMINON N is charged into the water tank.

(4) The beaker in the section (2) is set in the beaker fixing hole of the ultrasonic dispersing unit, and the ultrasonic dispersing unit is operated. Then, the height position of the beaker is adjusted in order to resonate the liquid level of the electrolyte aqueous solution in the beaker to the fullest extent possible.

(5) About 10 mg of a toner is gradually added to and dispersed in the electrolyte aqueous solution in the beaker in the section (4) in a state in which the electrolyte aqueous solution is irradiated with an ultrasonic wave. Then, the ultrasonic dispersion treatment is continued for an additional 60 seconds. It should be noted that the temperature of water in the water tank is appropriately adjusted so as to be 10° C. or more and 40° C. or less upon ultrasonic dispersion.

(6) The electrolyte aqueous solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight-average particle diameter (D4) is calculated. It should be noted that an "Average Diameter" on the "Analysis/volume Statistics (Arithmetic Average)" screen of the dedicated software when the dedicated software is set to show a graph in a vol % unit is the weight-average particle diameter (D4).

<Method of Measuring Volumetric Specific Heat>

The volumetric specific heat in the present invention is calculated from the product of both a specific heat (J/g·° C.) and true density (g/cm$^3$) individually determined for a sample.

An input compensation-type differential scanning calorimeter DSC8500 manufactured by TA Instruments is used in the measurement of the specific heat, and the measurement is performed according to a Step Scan mode. A pan made of aluminum is used for the sample and an empty pan is used for reference. After the sample has been left to stand at an equal temperature of 20° C. for 1 minute, its temperature is increased to 100° C. at 10° C./min, and its specific heat at 80° C. is calculated.

The true density is measured with a dry automatic densimeter AccuPyc 1330 manufactured by Shimadzu Corporation.

When the volumetric specific heat of organic-inorganic composite fine particles is measured, the organic-inorganic composite fine particles are isolated, for example, as described below. First, the toner is subjected to ultrasonic dispersion in ion-exchanged water to which several drops of "CONTAMINON N" (10 mass % aqueous solution of a neutral detergent for washing a precision measuring unit having a pH of 7, the detergent being formed of a nonionic surfactant, an anionic surfactant, and an organic builder, manufactured by Wako Pure Chemical Industries, Ltd.) have been added, followed by standing for 24 hours. The supernatant is collected and dried, whereby the external additive can be isolated. When a plurality of external additives are externally added to the toner, the external additives can be isolated by separating the supernatant according to a centrifugal separation method.

<Method of Measuring Number-average Particle Diameter of Organic-Inorganic Composite Fine Particles>

The measurement of the number-average particle diameter of the external additive is performed with a scanning electron microscope "S-4800" (trade name; manufactured by Hitachi, Ltd.). The toner to which the external additive has been externally added is observed, the long diameters of 100 primary particles of the external additive are randomly measured in a field of view magnified by a factor of up to 200,000, and their number-average particle diameter is determined. An observation magnification is appropriately adjusted depending on the size of the external additive.

<Method of Determining Organic-inorganic Composite Fine Particles in Magnetic Toner>

When the content of the organic-inorganic composite fine particles is measured in the magnetic toner obtained by externally adding a plurality of external additives to the magnetic toner particles, the external additives need to be removed from the magnetic toner particles, and the plurality of kinds of external additives need to be isolated and recovered.

A specific method therefor is, for example, the following method.

(1) 5 Grams of the magnetic toner is put in a sample bottle, and 200 ml of methanol is added thereto.

(2) The sample is dispersed with an ultrasonic cleaner for 5 minutes to separate the external additive.

(3) The resultant is subjected to suction filtration (membrane filter of 10 μm) to separate magnetic toner particles from the external additive. Alternatively, only a supernatant may be separated by bringing a neodymium magnet into contact with the bottom of the sample bottle so as to fix the magnetic toner particles.

(4) The above-mentioned operations (2) and (3) are performed three times in total.

The externally added external additives are isolated from the magnetic toner particles by the foregoing operations. The silica fine particles and the organic-inorganic composite fine particles are separated and recovered by subjecting the recovered aqueous solution to a centrifuge. Next, the solvent is removed, the residue is sufficiently dried with a vacuum dryer, and the mass of the dried product is measured. Thus, the content of the organic-inorganic composite fine particles can be obtained.

<Method of measuring Acid Value of Binder Resin>

The acid value in the present invention is determined by the following operations. A basic operation belongs to JIS K 0070.

Measurement is performed by using a potentiometric titration measuring apparatus as a measuring apparatus. Automatic titration with a potentiometric titration measuring apparatus AT-400 (win workstation) and an ABP-410 electric burette that are manufactured by Kyoto Electronics Manufacturing Co., Ltd. can be utilized in the titration.

A mixed solvent of 120 ml of toluene and 30 ml of ethanol is used in the calibration of the apparatus. A measurement temperature is set to 25° C.

A sample is prepared as described below. 0.5 Gram of a binder resin is loaded into the mixed solvent of 120 ml of toluene and 30 ml of ethanol, and is then subjected to ultrasonic dispersion for 10 minutes. After that, a magnetic stirrer is loaded into the mixture, and the binder resin is dissolved by stirring the mixture for about 10 hours in a lidded state. A blank test is performed with a 0.1 mol/l solution of potassium hydroxide in ethanol. The usage amount of the solution of potassium hydroxide in ethanol at this time is represented by B (ml). The magnetic material is separated from the sample solution after the 10 hours of stirring with a magnetic force, and soluble matter (sample solution containing the magnetic toner or the resin) is titrated. The usage amount of the potassium hydroxide solution at this time is represented by S (ml).

The acid value is calculated with the following equation. It should be noted that f in the equation represents the factor of KOH.

$$\text{Acid value(mgKOH/g)}=\{(S-B)\times f\times 5.61\}/W$$

<Methods of Measuring Melting Point of Releasing Agent and Half Width of Endothermic Peak of Toner Particles>

The melting point of the releasing agent and the half width of the endothermic peak of the toner particles are measured in conformity with ASTM D3418-82 by using a differential scanning calorimeter (DSC measurement apparatus) DSC-7 (manufactured by PerkinElmer).

5 Milligrams or more and 20 mg or less, preferably 10 mg of a measurement sample is precisely weighed.

The sample is loaded into an aluminum pan, and is subjected to the measurement by using an empty aluminum pan as a reference in the measurement temperature range of from 30° C. to 200° C. at a rate of temperature increase of 10° C./min under normal temperature and normal humidity. It should be noted that in the measurement, the temperature of the sample is increased to 200° C. once at a rate of temperature increase of 10° C./min, subsequently decreased to 30° C. at 10° C./min, and then increased again at a rate of temperature increase of 10° C./min. In the second temperature increase process, the highest endothermic peak is obtained in the temperature range of from 40° C. to 120° C. The peak temperature of the highest endothermic peak is defined as the melting point of the releasing agent.

In addition, the temperature width of the endothermic chart of a portion corresponding to one half of a peak height from a baseline in the endothermic peak when the measurement is performed by the same measurement method as that described above except that the measurement sample is changed to the toner particles is defined as the half width of the endothermic peak of the toner particles.

The present invention is specifically described below based on Examples. However, the embodiment of the present invention is by no means limited by Examples. The number of parts in Examples is represented in a "part(s) by mass" unit.

<Organic-inorganic Composite Fine Particles 1 to 6>

With regard to organic-inorganic composite fine particles to be used in Examples to be described later, fine particles produced by using silica shown in Table 1 in accordance with Example 1 of International Patent W02013/063291A are prepared as organic-inorganic composite fine particles 1 to 5. Fine particles produced in accordance with the production example of the composite fine particles of Japanese Patent Application Laid-Open No. 2005-202131 are prepared as organic-inorganic composite fine particles 6. The physical properties of the organic-inorganic composite fine particles 1 to 6 are shown in Table 1.

TABLE 1

| Organic-inorganic composite fine particles | Kind of inorganic fine particles b | Number-average particle diameter (D1) of primary particles of inorganic fine particles "b" (nm) | Resin component to be incorporated | Ratio of inorganic fine particles (mass %) | Volumetric specific heat (kJ/(m$^3$ · ° C.)) |
|---|---|---|---|---|---|
| Organic-inorganic composite fine particles 1 | Colloidal silica | 25 | MPS polymer | 56.5 | 3,300 |
| Organic-inorganic composite fine particles 2 | Colloidal silica | 50 | MPS polymer | 45.0 | 2,910 |
| Organic-inorganic composite fine particles 3 | Colloidal silica | 25 | MPS polymer | 66.5 | 4,150 |
| Organic-inorganic composite fine particles 4 | Colloidal silica | 25 | MPS polymer | 56.0 | 3,400 |
| Organic-inorganic composite fine particles 5 | Colloidal silica | 15 | MPS polymer | 64.1 | 3,010 |
| Organic-inorganic composite fine particles 6 | Colloidal silica | 8 | MPS polymer | 9.0 | 5,200 |

MPS: Methacryloxypropyltrimethoxysilane

<Other Additives>

The inorganic fine particles "a" and other additives to be used in toner production examples to be described later in addition to the organic-inorganic composite fine particles are shown in Tables 2 and 3.

TABLE 2

| Inorganic fine particles a | Kind of inorganic fine particles a |
|---|---|
| Inorganic fine particles a1 | Fumed silica |
| Inorganic fine particles a2 | Fumed silica |
| Inorganic fine particles a3 | Fumed silica |
| Inorganic fine particles a4 | Fumed silica |

TABLE 3

| Additive | Kind of additive |
|---|---|
| Additive 1 | Colloidal silica |
| Additive 2 | Resin particles |
| Additive 3 | Titania |

<Production Example of Binder Resin>

(Binder Resin Production Example 1)

The molar ratio among monomers for polyester is as described below.

BPA-PO/BPA-E0/TPA/TMA=50/50/70/12

In the equation, BPA-PO, BPA-EO, TPA, and TMA represent bisphenol A propylene oxide (2.2 mole) adduct, bisphenol A ethylene oxide (2.2 mole) adduct, terephthalic acid, and trimellitic anhydride, respectively.

Raw material monomers except TMA out of the raw material monomers described above and 0.1 mass % of tetrabutyl titanate as a catalyst are loaded into a flask mounted with, for example, a dehydration tube, a stirring blade, and a nitrogen-introducing tube, and are subjected to condensation polymerization at 220° C. for 10 hours. Further, TMA is added to the resultant and the mixture is subjected to a reaction at 210° C. until a desired acid value is obtained. Thus, a binder resin 1 shown in Table 4 is obtained.

(Binder Resin Production Examples 2 and 3)

A peak molecular weight, a glass transition point Tg, and an acid value are appropriately adjusted by changing the ratios of the raw material monomers in Binder Resin Production Example 1. Thus, binder resins 2 and 3 shown in Table 4 are obtained.

(Binder Resin Production Example 4)

300 Parts of xylene is loaded into a four-necked flask and the container is sufficiently purged with nitrogen while xylene is stirred. After that, a temperature in the container is increased to reflux xylene.

Under the reflux, a mixed liquid of 73.5 parts of styrene, 20 parts of n-butyl acrylate, 5 parts of monobutyl maleate, and 1.5 parts of di-tert-butyl peroxide is dropped to the flask over 4 hours. After that, polymerization is completed by holding the mixture for 2 hours. Thus, a solution of a low-molecular weight polymer (L-1) is obtained.

180 Parts of degassed water and 20 parts of a 2 mass % aqueous solution of a polyvinyl alcohol are loaded into the four-necked flask. After that, a mixed liquid of solutions of 70 parts of styrene, 25 parts of n-butyl acrylate, 5 parts of monobutyl maleate, 0.003 part of divinylbenzene, and 0.1 part of 2,2-bis(4,4-di-tert-butylperoxycyclohexyl)propane (half-life 10-hour temperature: 92° C.) is added to the flask, and the mixture is stirred to provide a suspension.

After the flask has been sufficiently purged with nitrogen, polymerization is initiated by increasing a temperature in the flask to 85° C. After the temperature has been held at the value for 24 hours, 0.1 part of benzoyl peroxide (half-life 10-hour temperature: 92° C.) is added to the flask. Further, the polymerization is completed by holding the mixture for 12 hours. The resultant is separated by filtration, washed with water, and dried to provide a high-molecular weight polymer (H-1).

70 Parts of the low-molecular weight polymer (L-1) and 30 parts of the high-molecular weight polymer (H-1) are dissolved in 100 parts of the refluxed xylene, and then the organic solvent is removed by distillation. Thus, a binder resin 4 shown in Table 4 is obtained.

(Binder Resin Production Examples 5 and 6)

A peak molecular weight, a glass transition point Tg, and an acid value are appropriately adjusted by changing the ratios of the raw material monomers in Binder Resin Production Example 4. Thus, binder resins 5 and 6 shown in Table 4 are obtained.

TABLE 4

| Binder resin | Kind of resin | Main peak molecular weight | Tg | Acid value |
|---|---|---|---|---|
| Binder resin 1 | Polyester resin | 6,200 | 64 | 17 |
| Binder resin 2 | Polyester resin | 6,000 | 63 | 25 |
| Binder resin 3 | Polyester resin | 5,800 | 62 | 31 |
| Binder resin 4 | Styrene-acrylic resin | 15,000 | 62 | 20 |
| Binder resin 5 | Styrene-acrylic resin | 10,000 | 59 | 10 |
| Binder resin 6 | Styrene-acrylic resin | 11,000 | 60 | 2 |

<Releasing Agent Production Example 1>

120 Parts of benzene, 100 parts of behenic acid, 80 parts of behenyl alcohol, and 8.0 parts of p-toluenesulfonic acid are loaded into a four-necked flask reactor mounted with a Dimroth reflux condenser and a Dean-Stark water separator, and are sufficiently stirred and dissolved, followed by reflux for 5 hours. After that, the valve of the water separator is opened and removal by azeotropic distillation is performed. After the removal by azeotropic distillation, the residue is sufficiently washed with sodium hydrogen carbonate. After that, the washed product is dried and benzene is removed by distillation. The resultant product is recrystallized, and is then washed and purified to synthesize a releasing agent 1 shown in Table 5.

<Releasing Agent Production Examples 2 to 4>

Releasing agents 2 to 4 shown in Table 5 are obtained by changing the kinds and amounts of the fatty acid and alcohol serving as raw materials in Releasing Agent Production Example 1.

<Releasing Agent 5>

Carnauba wax manufactured by Toa Kasei Co., Ltd. is used as a releasing agent 5 shown in Table 5.

<Releasing Agent 6>

A releasing agent 6 shown in Table 5 is polyethylene wax.

<Magnetic Toner Particle Production Example 1>

Binder resin 1 shown in Table 4: 100 parts (Peak molecular weight: 6,200, Tg: 64° C., acid value: 17 mgKOH/g)

Releasing agent 1 shown in Table 5: 5 parts (Behenyl behenate, melting point: 73° C.)

Magnetic material: 95.0 parts (Composition: $Fe_3O_4$ shape: spherical, number-average particle diameter of primary particles: 0.21 μm, magnetic properties at 795.8 kA/m; Hc: 5.5 kA/m, σs: 84.0 $Am^2/kg$, σr: 6.4 $Am^2/kg$)

Charge control agent: T-77 (manufactured by Hodogaya Chemical Co., Ltd.): 1.0 part The raw materials are premixed with a Henschel mixer FM10C (Mitsui Miike Kakoki). After that, the mixture is kneaded with a biaxial kneading extruder (PCM-30: manufactured by Ikegai Tekkosho Co., Ltd.) whose number of revolutions has been set to 200 rpm while its preset temperature is regulated so that the direct temperature of a kneaded product near its outlet may be 155° C.

The resultant molten kneaded product is cooled, and the cooled molten kneaded product is coarsely pulverized with a cutter mill. After that, the resultant coarsely pulverized product is finely pulverized with Turbo Mill T-250 (manufactured by Turbo Kogyo Co., Ltd.) while a feed amount is set to 20 kg/hr and an air temperature is adjusted so that an exhaust gas temperature may be 38° C. The finely pulverized product is classified with a multi-division classifier utilizing the Coanda effect to provide magnetic toner particles 1 having a weight-average particle diameter (D4) of 7.8 μm. The results are shown in Table 6.

<Magnetic Toner Particle Production Examples 2 to 10>

Magnetic toner particles 2 to 10 are obtained in the same manner as in Magnetic Toner Particle Production Example 1 except that in Magnetic Toner Particle Production Example 1, the kinds of the binder resin shown in Table 6 and the releasing agent shown in Table 6 are changed. The production formulations and weight-average particle diameters (D4) of the magnetic toner particles 2 to 10 are shown in Table 6.

TABLE 5

| Releasing agent | Constituent fatty acid | Constituent alcohol | Ester name | Melting point (° C.) | Number of carbon atoms of fatty acid | Number of functional groups of ester |
|---|---|---|---|---|---|---|
| Releasing agent 1 | Behenic acid | Behenyl alcohol | Behenyl behenate | 71 | 22 | 1 |
| Releasing agent 2 | Sebacic acid | Dibehenyl alcohol | Dibehenyl sebacate | 73 | 26 | 2 |
| Releasing agent 3 | Stearic acid | Pentaerythritol | Pentaerythritol stearic acid ester | 76 | 18 | 4 |
| Releasing agent 4 | Stearic acid | Dipentaerythritol | Dipentaerythritol stearic acid ester | 77 | 18 | 6 |
| Releasing agent 5 | | Natural wax | Carnauba wax | 81 | — | — |
| Releasing agent 6 | — | — | — | 100 | — | — |

TABLE 6

| Magnetic toner particles | Binder resin | Kind of releasing agent | Addition number of parts of releasing agent per 100 parts of binder resin (part(s) by mass) | Weight-average particle diameter D4 (μm) | Half width of endothermic peak (° C.) |
|---|---|---|---|---|---|
| Magnetic toner particles 1 | Binder resin 1 | Releasing agent 1 | 5 | 7.8 | 4.6 |
| Magnetic toner particles 2 | Binder resin 1 | Releasing agent 2 | 5 | 7.9 | 3.2 |
| Magnetic toner particles 3 | Binder resin 1 | Releasing agent 5 | 5 | 7.8 | 8.6 |
| Magnetic toner particles 4 | Binder resin 2 | Releasing agent 3 | 5 | 8.0 | 5.5 |
| Magnetic toner particles 5 | Binder resin 3 | Releasing agent 4 | 5 | 7.9 | 6 |
| Magnetic toner particles 6 | Binder resin 4 | Releasing agent 1 | 5 | 7.9 | 4 |
| Magnetic toner particles 7 | Binder resin 4 | Releasing agent 2 | 5 | 7.8 | 3 |
| Magnetic toner particles 8 | Binder resin 5 | Releasing agent 1 | 5 | 7.9 | 5 |
| Magnetic toner particles 9 | Binder resin 6 | Releasing agent 1 | 5 | 8.0 | 5.8 |
| Magnetic toner particles 10 | Binder resin 3 | Releasing agent 6 | 5 | 8.0 | 2 |

<Production of Magnetic Toner>

EXAMPLE 1

The magnetic toner particles 1 obtained in Magnetic Toner Particle Production Example 1 are subjected to an external addition and mixing treatment with an apparatus illustrated in FIG. 1.

Figure 2:
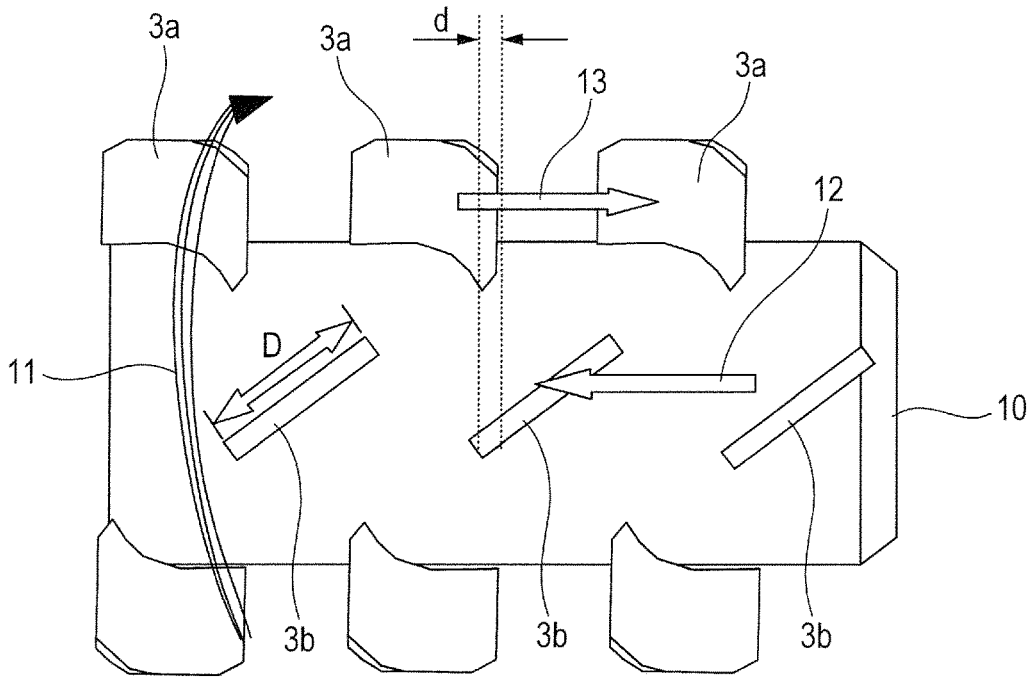
FIG. 2 is a schematic view for illustrating an example of the construction of a stirring member to be used in the mixing treatment apparatus.

In this example, the apparatus illustrated in FIG. 1 in which the diameter of the inner peripheral portion of a main body casing 1 is 130 mm and the volume of a treatment space 9 is 2.0×10-3 m3 is used, the rated power of a driving portion 8 is set to 5.5 kW, and stirring members 3 are shaped as illustrated in FIG. 2. In addition, an overlapping width d between a stirring member 3*a* and a stirring member 3*b* in FIG. 2 is set to 0.25D with respect to a maximum width D of each of the stirring members 3, and a clearance between each of the stirring members 3 and the inner periphery of the main body casing 1 is set to 3.0 mm.

100 Parts of the magnetic toner particles 1, and additives shown in Tables 1 and 2 whose kinds and addition amounts were shown in Table 7 were loaded into the apparatus illustrated in FIG. 1 having the above-mentioned apparatus construction.

After the magnetic toner particles, and the organic-inorganic composite fine particles 1 and the inorganic fine particles a1 as additives have been loaded, premixing is performed for uniformly mixing the magnetic toner particles and the silica fine particles. The premixing is performed under the conditions of a power of the driving portion 8 of 0.1 W/g (number of revolutions of the driving portion 8: 150 rpm) and a treatment time of 1 minute.

After the completion of the premixing, the external addition and mixing treatment is performed. Conditions for the external addition and mixing treatment are as follows: the peripheral speed of the outermost end portion of each of the stirring members 3 is adjusted so that the power of the driving portion 8 may take a constant value of 1.0 W/g (number of revolutions of the driving portion 8: 1,800 rpm), and a treatment time is set to 5 minutes. The conditions for the external addition and mixing treatment are shown in Table 7.

After the external addition and mixing treatment, coarse particles and the like are removed with a circular vibrating sieve in which a screen having a diameter of 500 mm and an aperture of 75 μm has been placed. Thus, a magnetic toner 1 is obtained. It should be noted that the number-average particle diameters of the primary particles of the organic-inorganic composite fine particles 1 and inorganic fine particles a1 on the surface of the magnetic toner 1 have been measured by magnifying and observing the magnetic toner with a scanning electron microscope, and have been confirmed to be as shown in the external additive physical property table of Table 7. Further, the contents of the organic-inorganic composite fine particles 1 and inorganic fine particles a1 in the magnetic toner are confirmed based on the above-mentioned experiment methods. External addition conditions for the magnetic toner 1 and its respective physical properties are shown in Table 7 and Table 8, respectively.

TABLE 7

| | | Organic-inorganic composite fine particles | | Other additive | | Inorganic fine particles a1 | | | Operating condition | Operating |
|---|---|---|---|---|---|---|---|---|---|---|
| Magnetic toner | Magnetic toner particles | Kind of organic-inorganic composite fine particles | Addition number of parts by mass | Kind of additive | Addition number of parts by mass | Kind of inorganic fine particles | Addition number of parts by mass | External addition apparatus | for external addition apparatus | time of external addition apparatus |
| Magnetic toner 1 | Magnetic toner particles 1 | Organic-inorganic composite fine particles 1 | 1.1 | — | — | Inorganic fine particles a1 | 2.0 | Apparatus of FIG. 1 | 1.0 W/g | 5 min |
| Magnetic toner 2 | Magnetic toner particles 7 | Organic-inorganic composite fine particles 1 | 1.1 | — | — | Inorganic fine particles a1 | 2.0 | Apparatus of FIG. 1 | 1.0 W/g | 5 min |
| Magnetic toner 3 | Magnetic toner particles 8 | Organic-inorganic composite fine particles 2 | 1.5 | — | — | Inorganic fine particles a1 | 2.0 | Apparatus of FIG. 1 | 1.0 W/g | 5 min |
| Magnetic toner 4 | Magnetic toner particles 3 | Organic-inorganic composite fine particles 2 | 1.5 | — | — | Inorganic fine particles a1 | 2.0 | Henschel mixer | 4,000 rpm | 4 min |
| Magnetic toner 5 | Magnetic toner particles 3 | Organic-inorganic composite fine particles 2 | 1.5 | — | — | Inorganic fine particles a1 | 2.0 | Hybridizer | 6,000 rpm | 5 min |
| Magnetic toner 6 | Magnetic toner particles 1 | Organic-inorganic composite fine particles 3 | 0.6 | — | — | Inorganic fine particles a1 | 2.0 | Apparatus of FIG. 1 | 1.0 W/g | 5 min |
| Magnetic toner 7 | Magnetic toner particles 1 | Organic-inorganic composite fine particles 3 | 2.9 | — | — | Inorganic fine particles a1 | 2.0 | Apparatus of FIG. 1 | 1.0 W/g | 5 min |
| Magnetic toner 8 | Magnetic toner particles 8 | Organic-inorganic composite fine particles 4 | 2.0 | — | — | Inorganic fine particles a1 | 2.5 | Apparatus of FIG. 1 | 1.0 W/g | 5 min |
| Magnetic toner 9 | Magnetic toner particles 4 | Organic-inorganic composite fine particles 5 | 0.8 | — | — | Inorganic fine particles a1 | 1.5 | Apparatus of FIG. 1 | 1.0 W/g | 5 min |
| Magnetic toner 10 | Magnetic toner particles 9 | Organic-inorganic composite fine particles 1 | 1.1 | — | — | Inorganic fine particles a1 | 2.0 | Apparatus of FIG. 1 | 1.0 W/g | 5 min |
| Magnetic toner 11 | Magnetic toner particles 5 | Organic-inorganic composite fine particles 1 | 1.1 | — | — | Inorganic fine particles a1 | 2.0 | Apparatus of FIG. 1 | 1.0 W/g | 5 min |
| Magnetic toner 12 | Magnetic toner particles 2 | Organic-inorganic composite fine particles 1 | 1.1 | — | — | Inorganic fine particles a2 | 2.0 | Apparatus of FIG. 1 | 1.0 W/g | 5 min |
| Magnetic toner 13 | Magnetic toner particles 6 | Organic-inorganic composite fine particles 1 | 1.1 | — | — | Inorganicfine particles a3 | 2.0 | Apparatus of FIG. 1 | 1.0 W/g | 5 min |
| Magnetic toner 14 | Magnetic toner particles 1 | Organic-inorganic composite fine particles 2 | 0.3 | — | — | Inorganic fine particles a1 | 2.0 | Apparatus of FIG. 1 | 1.0 W/g | 5 min |
| Magnetic toner 15 | Magnetic toner particles 1 | Organic-inorganic composite fine particles 1 | 3.5 | — | — | Inorganic fine particles a1 | 2.0 | Apparatus of FIG. 1 | 1.0 W/g | 5 min |

TABLE 7-continued

| Magnetic toner | Magnetic toner particles | Organic-inorganic composite fine particles: Kind of organic-inorganic composite fine particles | Organic-inorganic composite fine particles: Addition number of parts by mass | Other additive: Kind of additive | Other additive: Addition number of parts by mass | Inorganic fine particles a1: Kind of inorganic fine particles | Inorganic fine particles a1: Addition number of parts by mass | External addition apparatus | Operating condition for external addition apparatus | Operating time of external addition apparatus |
|---|---|---|---|---|---|---|---|---|---|---|
| Magnetic toner 16 | Magnetic toner particles 1 | — | — | Additive 2 | 1.5 | Inorganic fine particles a1 | 2.0 | Apparatus of FIG. 1 | 1.0 W/g | 5 min |
| Magnetic toner 17 | Magnetic toner particles 1 | — | — | Additive 3 | 1.5 | Inorganic fine particles a1 | 2.0 | Apparatus of FIG. 1 | 1.0 W/g | 5 min |
| Magnetic toner 18 | Magnetic toner particles 10 | Organic-inorganic composite fine particles 2 | 3.0 | — | — | Inorganic fine particles a1 | 2.0 | Apparatus of FIG. 1 | 1.0 W/g | 5 min |
| Magnetic toner 19 | Magnetic toner particles 8 | Organic-inorganic composite fine particles 2 | 1.5 | — | — | Inorganic fine particles a4 | 2.0 | Apparatus of FIG. 1 | 1.0 W/g | 5 min |
| Magnetic toner 20 | Magnetic toner particles 8 | Organic-inorganic composite fine particles 2 | 1.5 | — | — | Inorganic fine particles a1 | 2.6 | Apparatus of FIG. 1 | 1.0 W/g | 5 min |
| Magnetic toner 21 | Magnetic toner particles 1 | — | — | — | — | Inorganic fine particles a1 | 2.0 | Henschel mixer | 4,000 rpm | 4 min |
| Magnetic toner 22 | Magnetic toner particles 1 | — | — | — | — | Inorganic fine particles a1 | 2.4 | Apparatus of FIG. 1 | 1.0 W/g | 5 min |
| Magnetic toner 23 | Magnetic toner particles 8 | — | — | Additive 1 | 1.8 | Inorganic fine particles a1 | 2.0 | Apparatus of FIG. 1 | 1.0 W/g | 5 min |
| Magnetic toner 24 | Magnetic toner particles 1 | Organic-inorganic composite fine particles 6 | 1.1 | — | — | Inorganic fine particles a1 | 2.0 | Apparatus of FIG. 1 | 1.0 W/g | 5 min |

TABLE 8

| Magnetic toner | Number-average particle diameter of organic-inorganic composite fine particles on toner (nm) | Content of organic-inorganic composite fine particles in magnetic toner (part(s) by mass) | Volumetric specific heat of organic-inorganic composite fine particles (kJ/(m$^3$ · ° C.)) | Number-average particle diameter of other additive on toner (nm) | Content of other additive in magnetic toner (part(s) by mass) | Number-average particle diameter of inorganic fine particles on toner (nm) | Content of inorganic fine particles "a" in magnetic toner (part(s) by mass) | Coverage A (%) | B/A (—) | Coefficient of variation (%) |
|---|---|---|---|---|---|---|---|---|---|---|
| Magnetic toner 1 | 110 | 1.09 | 3,280 | — | — | 14 | 1.98 | 55.0 | 0.76 | 6.5 |
| Magnetic toner 2 | 114 | 1.08 | 3,310 | — | — | 15 | 1.97 | 55.0 | 0.76 | 6.5 |
| Magnetic toner 3 | 208 | 1.5 | 2,920 | — | — | 14 | 1.99 | 54.0 | 0.75 | 6.5 |
| Magnetic toner 4 | 205 | 1.49 | 2,900 | — | — | 15 | 1.99 | 52.0 | 0.49 | 18.0 |
| Magnetic toner 5 | 213 | 1.5 | 2,910 | — | — | 16 | 1.98 | 50.0 | 0.89 | 11.0 |
| Magnetic toner 6 | 106 | 0.58 | 4,150 | — | — | 14 | 1.98 | 55.0 | 0.78 | 6.5 |
| Magnetic toner 7 | 104 | 0.58 | 4,200 | — | — | 14 | 1.99 | 55.0 | 0.73 | 6.5 |
| Magnetic toner 8 | 160 | 2.88 | 3,250 | — | — | 15 | 2.48 | 68.0 | 0.85 | 8.5 |
| Magnetic toner 9 | 64 | 0.79 | 3,000 | — | — | 13 | 1.47 | 48.0 | 0.55 | 9.8 |

TABLE 8-continued

| Magnetic toner | Number-average particle diameter of organic-inorganic composite fine particles on toner (nm) | Content of organic-inorganic composite fine particles in magnetic toner (part(s) by mass) | Volumetric specific heat of organic-inorganic composite fine particles (kJ/(m$^3$ · ° C.)) | Number-average particle diameter of other additive on toner (nm) | Content of other additive in magnetic toner (part(s) by mass) | Number-average particle diameter of inorganic fine particles on toner (nm) | Content of inorganic fine particles "a" in magnetic toner (part(s) by mass) | Coverage A (%) | B/A (—) | Coefficient of variation (%) |
|---|---|---|---|---|---|---|---|---|---|---|
| Magnetic toner 10 | 112 | 1.09 | 3,270 | — | — | 16 | 1.99 | 55.0 | 0.65 | 7.5 |
| Magnetic toner 11 | 111 | 1.1 | 3,310 | — | — | 15 | 1.99 | 54.0 | 0.81 | 6.2 |
| Magnetic toner 12 | 114 | 1.07 | 3,300 | — | — | 11 | 1.97 | 58.0 | 0.79 | 6.2 |
| Magnetic toner 13 | 115 | 1.09 | 3,320 | — | — | 25 | 1.99 | 52.0 | 0.72 | 8.0 |
| Magnetic toner 14 | 214 | 0.3 | 2,900 | — | — | 15 | 1.99 | 55.0 | 0.76 | 6.6 |
| Magnetic toner 15 | 112 | 3.49 | 2,910 | — | — | 14 | 1.98 | 53.0 | 0.74 | 6.8 |
| Magnetic toner 16 | — | — | 2,930 | 148 | 1.47 | 17 | 1.98 | 52.0 | 0.72 | 7.0 |
| Magnetic toner 17 | — | — | 6,340 | 265 | 1.48 | 16 | 1.99 | 54.0 | 0.76 | 6.7 |
| Magnetic toner 18 | 212 | 3 | 2,910 | — | — | 17 | 1.99 | 55.0 | 0.72 | 6.9 |
| Magnetic toner 19 | 210 | 1.49 | 2,920 | — | — | 42 | 1.99 | 42.0 | 0.46 | 10.5 |
| Magnetic toner 20 | 209 | 1.48 | 2,930 | — | — | 14 | 2.58 | 75.0 | 0.73 | 6.6 |
| Magnetic toner 21 | — | — | — | — | — | 15 | 1.99 | 50.0 | 0.47 | 18.5 |
| Magnetic toner 22 | — | — | — | — | — | 16 | 2.4 | 63.0 | 0.77 | 6.5 |
| Magnetic toner 23 | — | — | 3,780 | 101 | — | 14 | *3.77 | 50.0 | 0.68 | 8.0 |
| Magnetic toner 24 | 125 | 1.07 | 5,100 | — | — | 16 | 1.98 | 50.0 | 0.76 | 6.5 |

*The content of the inorganic fine particles "a" in the magnetic toner 23 is a total content with colloidal silica.

<Evaluation for Developability>

An evaluation is performed with HP LaserJet Enterprise 600 M603dn.

The apparatus is reconstructed so as to have a process speed of 400 mm/s, which is higher than its original process speed, before use.

982 Grams of the magnetic toner 1 is loaded into a predetermined process cartridge. The test is performed under a high-temperature and high-humidity environment (32.5° C., 80% RH) as an additionally severe condition that softens a base resin and accelerates the embedding of an external additive. A durability test is performed as follows: the printing of a horizontal line pattern having a print percentage of 1% on two sheets is defined as one job, and an image output test is performed on a total of 25,000 sheets according to a mode set so that the machine may stop once between a job and the next job before the next job starts.

An evaluation for an image density is performed by measuring the reflection density of a 5-mm circular solid black image with a Macbeth densitometer (manufactured by GretagMacbeth) as a reflection densitometer and a SPI filter. A larger numerical value means that the developability of the toner is better. Specific evaluation criteria are described below.

A: A reflection density of 1.40 or more is maintained during a time period from the initial stage to the output on the 25,000th sheet.

B: A reflection density of 1.35 or more and less than 1.40 is maintained during a time period from the initial stage to the output on the 25,000th sheet.

C: A reflection density of 1.30 or more and less than 1.35 is maintained during a time period from the initial stage to the output on the 25,000th sheet.

D: A reflection density of 1.30 cannot be maintained until the completion of the output on the 25,000th sheet.

The result is shown in Table 9.

<Evaluation for Low-Temperature Fixability>

HP LaserJet Enterprise 600 M603dn is reconstructed so that the fixation temperature of its fixing unit can be arbitrarily set. The test is performed under a normal environment (23° C., 50% RH).

A halftone image is output on bond paper (basis weight: 75 g/m$^2$) so as to have an image density of from 0.6 to 0.65 with the apparatus while the temperature of the fixing unit is set to 230° C. The resultant image is rubbed with lens-cleaning paper under a load of 4.9 kPa in a reciprocating manner five times, and the percentage by which the image density reduces after the rubbing as compared to that before the rubbing is measured. Specific evaluation criteria are described below.

The temperature at which the percentage by which the image density reduces becomes 10.0% or less is A: less than 220° C., B: 220° C. or more and less than 230° C., C: 230° C. or more and less than 240° C., or D: 240° C. or more.

The result is shown in Table 9.

<Evaluation for Resistance to Adhesion of Printed Paper>

In an evaluation for resistance to the adhesion of printed paper, HP LaserJet Enterprise 600 M603dn (manufactured by Hewlett-Packard Company) is used after having been reconstructed so as to have a process speed of 400 mm/s.

The test is performed under a high-temperature and high-humidity environment (32.5° C., 80% RH) as a condition additionally severe on the resistance to the adhesion of printed paper.

In the evaluation, first, a continuous printing test is performed on both surfaces of each of 10 sheets of Office Planner A4 paper (basis weight: 68 g/m$^2$) by using a test chart having a print percentage of 6%. After that, the 10 sheets are superimposed, and a load is applied to the sheets in the superimposed state for 1 hour by superimposing 7 unopened sheaves (500 sheets/sheaf) (corresponding to 3,500 sheets) of the Office Planner paper, followed by the evaluation of a state upon peeling of the sheets. Specific evaluation criteria are described below.

A: No adhesion of printed paper occurs.

B: Adhesion between the sheets of paper is observed, but no defect is observed in an image at the time of the peeling.

C: A defect is observed in an image at the time of the peeling, but is not at such a level as to cause a problem in practical use.

D: A remarkable defect is observed in an image at the time of the peeling.

The result is shown in Table 9.

EXAMPLES 2 to 13

Magnetic toners 2 to 13 are produced in the same manner as in Example 1 according to formulations shown in Table 7. The physical property values of the magnetic toners thus obtained are shown in Table 8, and results obtained by subjecting the toners to the same tests are shown in Table 9.

Comparative Examples 1 to 11

Magnetic toners 14 to 24 are produced in the same manner as in Example 1 according to formulations shown in Table 7. The physical property values of the magnetic toners thus obtained are shown in Table 8, and results obtained by subjecting the toners to the same tests are shown in Table 9.

TABLE 9

| | Magnetic toner | Low-temperature fixability | Developability (transition of density) | | | Resistance to adhesion of printed paper |
|---|---|---|---|---|---|---|
| | | | Initial stage | After passing of 25,000 sheets | Rank | |
| Example 1 | Magnetic toner 1 | 216 | 1.43 | 1.41 | A | A |
| Example 2 | Magnetic toner 2 | 215 | 1.44 | 1.42 | A | A |
| Example 3 | Magnetic toner 3 | 218 | 1.41 | 1.38 | B | A |
| Example 4 | Magnetic toner 4 | 219 | 1.40 | 1.36 | B | A |
| Example 5 | Magnetic toner 5 | 219 | 1.40 | 1.35 | B | A |
| Example 6 | Magnetic toner 6 | 218 | 1.41 | 1.33 | C | C |
| Example 7 | Magnetic toner 7 | 229 | 1.45 | 1.43 | A | C |
| Example 8 | Magnetic toner 8 | 231 | 1.42 | 1.40 | A | A |
| Example 9 | Magnetic toner 9 | 220 | 1.43 | 1.37 | B | A |
| Example 10 | Magnetic toner 10 | 230 | 1.40 | 1.35 | B | B |
| Example 11 | Magnetic toner 11 | 221 | 1.41 | 1.37 | B | B |
| Example 12 | Magnetic toner 12 | 219 | 1.42 | 1.38 | B | B |
| Example 13 | Magnetic toner 13 | 222 | 1.42 | 1.39 | B | B |
| Comparative Example 1 | Magnetic toner 14 | 219 | 1.39 | 1.32 | C | D |
| Comparative Example 2 | Magnetic toner 15 | 240 | 1.43 | 1.40 | A | A |
| Comparative Example 3 | Magnetic toner 16 | 214 | 1.35 | 1.27 | D | A |
| Comparative Example 4 | Magnetic toner 17 | 245 | 1.36 | 1.33 | C | D |
| Comparative Example 5 | Magnetic toner 18 | 242 | 1.39 | 1.35 | B | B |
| Comparative Example 6 | Magnetic toner 19 | 231 | 1.36 | 1.29 | D | B |
| Comparative Example 7 | Magnetic toner 20 | 240 | 1.42 | 1.39 | B | B |
| Comparative Example 8 | Magnetic toner 21 | 230 | 1.39 | 1.29 | D | D |
| Comparative Example 9 | Magnetic toner 22 | 220 | 1.40 | 1.34 | C | D |

TABLE 9-continued

| | Magnetic toner | Low-temperature fixability | Developability (transition of density) Initial stage | After passing of 25,000 sheets | Rank | Resistance to adhesion of printed paper |
|---|---|---|---|---|---|---|
| Comparative Example 10 | Magnetic toner 23 | 242 | 1.38 | 1.34 | C | C |
| Comparative Example 11 | Magnetic toner 24 | 244 | 1.41 | 1.38 | B | D |

REFERENCE SIGNS LIST

1: main body casing, 2: rotating body, 3, 3*a*, 3*b*: stirring member, 4: jacket, 5: raw material inlet, 6: product outlet, 7: central axis, 8: driving portion, 9: treatment space, 10: edge side of rotating body, 11: rotation direction, 12: return direction, 13: feed direction, 16: inner piece for raw material inlet, 17: inner piece for product outlet, d: space showing overlapping portion of stirring members, D: width of stirring member While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-161481, filed Aug. 7, 2014, which is hereby incorporated by reference herein in its entirety.

What is claimed is:

1. A magnetic toner, comprising:

a toner particle containing a binder resin, a magnetic material, and a releasing agent containing an ester compound; and an inorganic fine particle "a" and an organic-inorganic composite fine particle on each of surface of the toner particle, said organic-inorganic composite fine powder being present at 0.5 to 3.0 mass % with reference to the mass of the toner, the organic-inorganic composite fine particle having a volumetric specific heat at 80° C. of 2,900 to 4,200 kJ/($m^3$·° C.) and comprising a vinyl-based resin particle and an inorganic fine particle "b" embedded in the vinyl-based resin particle, wherein the inorganic fine particle "a" contains at least an inorganic oxide fine particle selected from the group consisting of a silica fine particle, a titania fine particle, and an alumina fine particle, and has a number-average particle diameter (D1) of 5 to 25 nm, coverage A (%) of each of the surface of the toner particle with the inorganic fine particle "a" is 45 to 70.0%, the toner particle has a endothermic peak measured with a differential scanning calorimeter (DSC), the half width of the endothermic peak is 2.0 to 8.0° C., and the binder resin has an acid value of 5 to 30 mgKOH/g.

2. A magnetic toner according to claim 1, wherein (B/A) is 0.50 to 0.85 when a coverage (B) % of the surface of the toner particle with the inorganic fine particle "a" fixed to the surface of the toner particle.

3. A magnetic toner according to claim 1, wherein a coefficient of variation of the coverage A between the toner particle is 10.0% or less.

4. A magnetic toner according to claim 1, wherein the organic-inorganic composite fine particle has a protruded portion derived from the inorganic fine particle "b" on a surface thereof, and has a number-average particle diameter of 50 to 200 nm.

5. The toner according to claim 1, wherein the toner contains the organic-inorganic composite fine particle at 0.79 to 3.0 mass % with reference to a mass of the toner.

6. The toner according to claim 1, wherein the toner particle contains the ester compound at 1.0 to 10.0 parts by mass with reference to a mass of the binder resin.

7. The toner according to claim 1, wherein the magnetic toner contains the magnetic material at 35 to 50 mass %.

8. The magnetic toner according to claim 1, wherein the organic-inorganic composite fine particle has a volumetric specific heat at 80° C. of 3,100 to 4,200 kJ/($m^3$·° C.).

9. The magnetic toner according to claim 1, wherein the releasing agent has a melting point of 60 to 90° C.

* * * * *